US007360762B2

(12) United States Patent
Itagaki et al.

(10) Patent No.: US 7,360,762 B2
(45) Date of Patent: Apr. 22, 2008

(54) DIE EYE NUMBER DETERMINATION METHOD, DIE EYE NUMBER DETERMINATION APPARATUS, AND ELECTRONIC APPARATUS USING SAME

(75) Inventors: Fumihiko Itagaki, Sapporo (JP); Satoshi Murakami, Sapporo (JP)

(73) Assignee: Hudson Soft Co., Ltd., Sapporo-shi, Hokkaido (JP)

( * ) Notice: Subject to any disclaimer, the term of this patent is extended or adjusted under 35 U.S.C. 154(b) by 313 days.

(21) Appl. No.: 11/001,582

(22) Filed: Dec. 2, 2004

(65) Prior Publication Data

US 2005/0137008 A1 Jun. 23, 2005

(30) Foreign Application Priority Data

Dec. 4, 2003 (JP) ..... 2003-406539

(51) Int. Cl.
*A63F 9/04* (2006.01)

(52) U.S. Cl. ..... 273/146; 463/22; 463/31; 273/460; 273/138.2

(58) Field of Classification Search ..... 463/22, 463/31; 273/146, 460, 138.2
See application file for complete search history.

(56) References Cited

U.S. PATENT DOCUMENTS 3,233,343 A * 2/1966 Short ..... 434/222
4,892,311 A * 1/1990 Zaitsu ..... 273/145 D
6,609,710 B1 * 8/2003 Order ..... 273/148 R
2005/0026680 A1 * 2/2005 Gururajan ..... 463/25

FOREIGN PATENT DOCUMENTS

| | | |
|---|---|---|
| JP | 01/198576 | 8/1989 |
| JP | 01-223988 | 9/1989 |
| JP | 05-212159 | 8/1993 |
| JP | 8-215423 | 8/1996 |
| JP | 09-044601 | 2/1997 |
| JP | 10-201945 | 8/1998 |
| JP | 2002-092746 | 3/2002 |

OTHER PUBLICATIONS

B. Correia et al, "Automated detection and classification of dice", Machine Vision Applications in Industrial Inspection III Feb. 8-9, Mar. 1995, vol. 2423, pp. 196-202, ISSN: 0277-786X.*

(Continued)

*Primary Examiner*—John M. Hotaling, II
*Assistant Examiner*—Jason Pinheiro
(74) *Attorney, Agent, or Firm*—McGinn IP Law Group, PLLC

(57) ABSTRACT

When dice are rolled inside the box, the images of the eyes on the lower face of the dice are captured. The CPU determines the eye number based upon the determination condition of at least one of the feature, the number, and the location state of the eyes in a predetermined area in the image-captured face according to the image information by the image-capturing section, as well as the programs stored in the ROM. The determined eye number is displayed on the display section through the display control section or the voice synthesized by the audio processing section is outputted from the speaker.

11 Claims, 16 Drawing Sheets

OTHER PUBLICATIONS

J. Celko, "Dice", http://www.gamecabinet.com/rules/Dice.html, Jan. 21, 1998, p. 1.*

I. Lapanja et al, "Computer vision based reliability control for electromechanical dice gambling machine", Proc IEEE Int Conf Ind Technol; Proceedings of the IEEE International Conference on Industrial Technology 2000, Jan. 2000, vol. 2, pp. 325-328.*

B. Correia, et al., "Automated detection and classification of dice", Machine Vision Applications in Industrial Inspection III Feb. 8-9, vol. 2423, Mar. 1995, pp. 196-202, XP002340768, ISSN: 0277-786X.

I. Lapanja, et al., "Computer vision based reliability control for electromechanical dice gambling machine", Proc IEEE Int Conf Ind Technol: Proceedings of the IEEE International Conference on Industrial Technology 2000 IEEE, vol. 2, Jan. 2000, pp. 325-328, XP002340779.

European Search Report dated Aug. 25, 2005.

Japanese Office Action, Jun. 5, 1997, Notification of Reason(s) for Refusal, Patent Application No. 2003-406539.

Japanese Decision of Refusal, Aug. 21, 2007, Decision of Refusal, Patent Application No. 2003-406539.

Communication pursuant to Article 96(2) EPC, mailed on Jul. 20, 2006.

B. Correia, J. A. Silva et al.: "Automated detection and classification of dice" Machine Visions Applications in Industrial Inspection, III Feb. 8-9, vol. 2423, Mar. 1995, pp. 196-202, XP002340768 ISSN: 0277-786X. (*Previously cited*.).

Summons to Attend Oral Proceedings Pursuant to Rule 71(1) EPC mailed on Jul. 5, 2007.

* cited by examiner

DIE EYE NUMBER DETERMINATION METHOD, DIE EYE NUMBER DETERMINATION APPARATUS, AND ELECTRONIC APPARATUS USING SAME

The present application is based on Japanese patent application No. 2003-406539, the entire contents of which are incorporated herein by reference.

BACKGROUND OF THE INVENTION

1. Field of the Invention

The present invention relates to a die eye number determination method, a die eye number determination apparatus, and an electronic apparatus using the same, and in particular to a die eye number determination method, a die eye number determination apparatus, and an electronic apparatus using the same, which can use a die available in the market, as well as can determine in image recognition eye numbers on a plurality of dice used at a time.

2. Background Information

For example, a sugoroku game requires a dice as a tool to play the game. And some of home video game machines, board games or the like require a dice. Conventionally determination of an eye number on a cast die is performed by visual observation of game participants.

However, in games such as electronic game personal machines or electronic personal computers, almost all of game contents, game progresses, win-loss records and the like are displayed on an image display and these games are performed by operating a controller or a keyboard. In case a player who is familiar with games such as the game personal machines or the personal computers play a conventional sugoroku game, the player is not familiar with an old-fashioned game method in which a player rolls a die with the player's hand and the eye number on the die is visually determined by the player. On the other hand, the elderly are difficult to become familiar with a purely electronic game in which a game is performed by an operation of a controller.

And there is a case where a die is used in anything other than a game. For example, in an arithmetic lesson in school, a math problem is set using a die as a teaching tool. Since the die is small, it is thought that students can not visualize a state of the die, such as an eye number and an eye color clearly, which causes weakening recognition of participation in lessons and reducing the interest in lessons by half.

Therefore, Japanese Unexamined Patent Publication No. 08-215423 has disclosed a dice eye recognition apparatus that can electronically determine the number of eyes on a dice. In the apparatus, a magnetic piece is housed in each face of the numbers 1-6, a magnet generated in the magnetic piece is detected by a magnetic sensor, and a detection signal by scanning is processed in a process control circuit, thereby to determine the number of eyes on the dice.

However, according to the conventional apparatus of determining the number of eyes on the dice, since special dice that houses a magnetic piece therein is necessary to use, dice commercially sold in a toy store or the like can not be used. And in a game using a die the number of dice is not limited to one, but there is a case a plurality of dice may be used. In this case there is no problem if all dice have the same size, the same specification (color, size and shape of eyes, and the like). However, in a case where not all dice have the same in the above aspects, it becomes difficult to confirm the number of eyes. Therefore, a conventional apparatus which can determine the number of eyes on dice available in the market are not provided yet.

In view of the above, there exists a need for a die eye number determination apparatus, a die eye number determination method, and an electronic apparatus using the same which overcome the above-mentioned problems in the related art. The present invention addresses this need in the related art and also other needs, which will become apparent to those skilled in the art from this disclosure.

SUMMARY OF THE INVENTION

It is an object of the present invention to a die eye number determination method, a die eye number determination apparatus, and an electronic apparatus using the same, which can use a die available in the market, as well as can determine the number of eyes even if a plurality of dice are used at a time.

According to a first aspect of the present invention, a die eye number determination method, comprises the steps of providing at least one die, the die having at least six faces and describing from one eye to at least six eyes on each of at least the six faces of the die, capturing an image of at least one of an upper face or a lower face of at least the six faces to generate an image signal, and determining an eye number based upon the image signal on a condition of at least one of a feature, a number, and a location relation of from the one eye to at least the six eyes in a predetermined area of the image captured face.

According to the method, since the image signal is generated by capturing an image of at least the one face of the die, and the eye number is determined by at least the one of the feature, the number, and the location relation of the eyes as a determination condition, the eye number on the die available in the market can be determined in image recognition.

According to a second aspect of the present invention, a die eye number determination method, comprises the steps of providing at least one die, the die having at least six faces and describing from one eye to at least six eyes on each of at least the six faces of the die, capturing an image of at least one of an upper face or a lower face of at least the six faces to generate an image signal, determining whether or not the number of the eyes in a predetermined area of the image captured face is only one, and thereafter determining the eye number corresponding to the other number.

According to the method, the image signal is generated by capturing an image of one face on the die and the determination on whether or not the number of the eyes described on the image captured face is only one in the first place, and thereafter determination on the eye number corresponding to the other number is made. Thereby in case a plurality of the dice are image captured at a time, even if each eye number of two dice is one at a time, the eye number can be determined by distinguishing the eye number of the one face over the eye number of the other face.

According to a third aspect of the present invention, a die eye number determination apparatus, comprises an image-capturing section to shoot one or a plurality of eyes described on an upper face or a lower face on at least one die for outputting an image information, a vessel wherein a space for rolling at least the one die is formed and the image-capturing section is located in a lower part or an upper part thereof, a determination section to determine an eye number based upon the image information by the image-capturing section on a condition of at least one of a feature, a number, and a location relation of the eyes in a predetermined area of image captured face, and an output section to display provide an audible announcement of a determination result by the determination section as a numerical value or output the determination result as die information of an electronic game.

According to the apparatus, the eyes described on the lower face or the upper face of the die rolled inside the vessel are imaged by the image-capturing section and the eye number is determined by the determination section based upon at least one of the feature, the number, and the location relation of the eyes that are set as a determination condition, as well as the determination result is displayed and voiced, and is outputted as die information. Thereby even if the die available in the market is used, the eye number can be determined in image recognition.

According to a fourth aspect of the present invention, an electronic apparatus equipped with a game-playing function to play a game provided by a memory medium storing game software or by connection to an internet and to output images and audios during game-playing through an external display and an external speaker, comprises a die eye number determination section to shoot one or a plurality of eyes described on an upper face or a lower face on at least one die for outputting an image information for determining an eye number based upon the image information by the image capturing of a condition of at least one of a feature, a number, and a location relation of the eyes in a predetermined area of a image captured face.

According to the electronic apparatus, since the eyes on the die are image captured by the die eye number determination section and the eye number of the die is determined based upon the feature, the number, and the location relation of the eyes for outputting, the determination result can be electronically reflected in the game and displayed.

ADVANTAGES OF THE INVENTION

According to the die eye number determination method in the first aspect of the present invention, since the image signal is generated by capturing an image of the one face of the die, and the eye number is determined by at least the one of the feature, the number, and the location relation of the eyes described on the image captured face as a determination condition, the eye number on the die available in the market can be determined in image recognition.

And according to the die eye number determination method in the second aspect of the present invention, the determination on whether or not the number of the eyes described on the image captured face is only one in the first place, and thereafter determination on the eye number corresponding to the other number is made. Thereby in a case a plurality of the dice are image captured at a time, even if each eye number of two dice is one at a time, the eye number can be determined by distinguishing the eye number of the one face over the eye number of the other face.

According to the apparatus in the third aspect of the present invention, since the eyes described on the lower face or the upper face of the die rolled inside the vessel are image captured by the image-capturing section and the eye number is determined by the determination section based upon at least one of the feature, the number, and the location relation of the eyes that are set as a determination condition, as well as the determination result is displayed/voiced and outputted as die information, the eye number of the die available in the market can be determined in image recognition, as well as the eye number can be recognized by many people and the eye number information can be used in games.

According to the electronic apparatus in the fourth aspect of the present invention, since the eyes on the die are image captured by the eye number determination section for the die and the eye number of the die is automatically determined based upon the feature, the number, and further the location relation of the eyes for displaying, and data of the eye number can be provided. This allows diversification of the games, as well as multi-function electronic apparatus used mainly for games.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
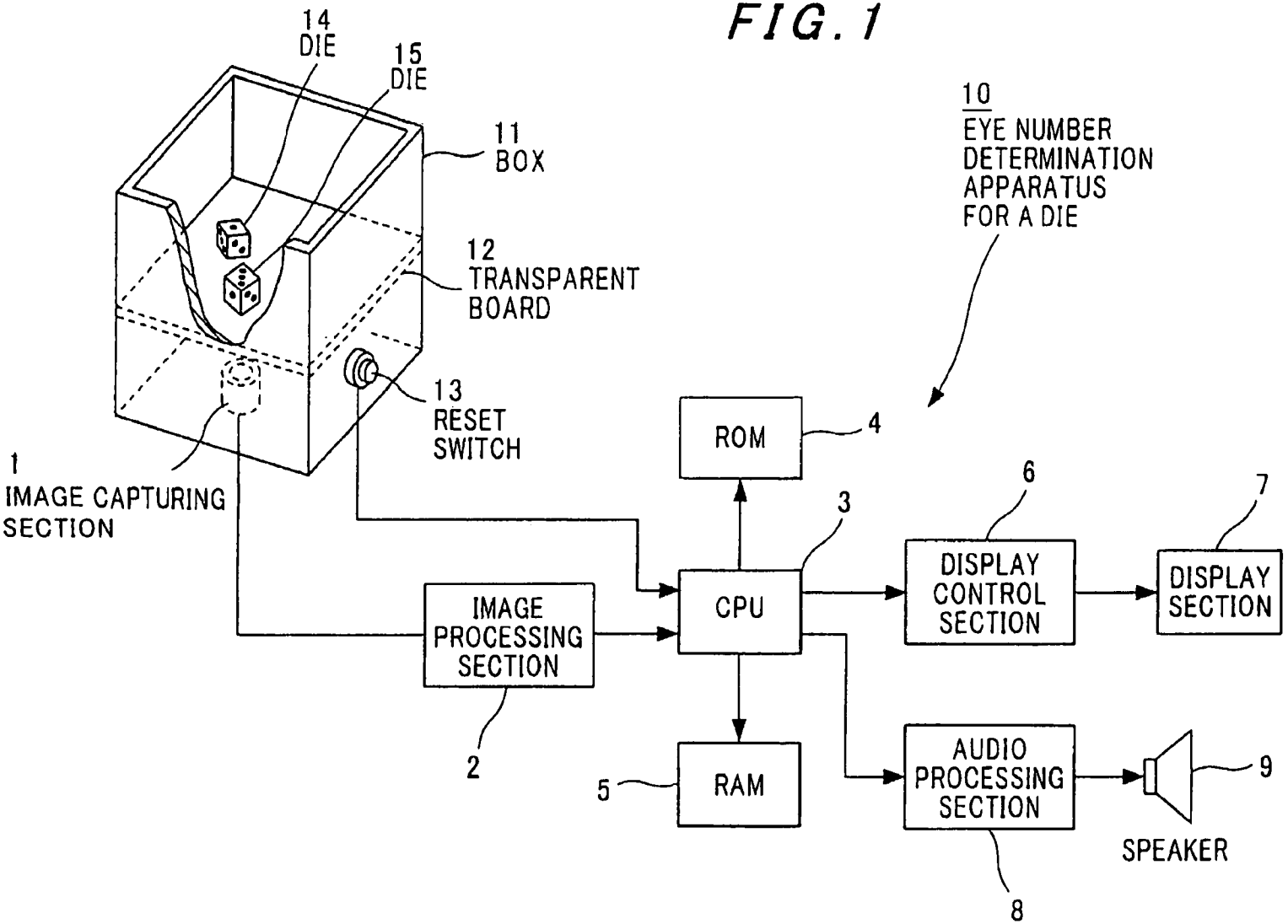
FIG. 1 is a block diagram showing a constitution of an eye number determination apparatus for a die in a first preferred embodiment.

FIG. 1 is a block diagram showing a constitution of a die eye number determination apparatus. A die eye number determination apparatus 10 comprises an image-capturing section 1, an image processing section 2, a CPU 3, a ROM 4 (read only memory), a RAM 5 (random access memory), a display control section 6, a display section 7, an audio processing section 8, a speaker 9, a box 11 as a vessel, a transparent board 12 disposed inside the box 11, and a reset switch 13.

It is noted that in fact the connection between the CPU 3 and other circuit sections is made through an interface, which is omitted herein. And a determination section is composed of the image processing section 2, the CPU 3, the ROM 4, and the RAM 5, and an output section is composed of each of the display control section 6 and the display section 7, and each of the audio processing section 8 and the speaker 9.

Dice 14, 15 are available in the market and a player basically prepares them by himself or herself, and the dice 14, 15 may be attached to the die eye number determination apparatus 10 for selling. In FIG. 1, the eye number is displayed in numbers and also outputted by audio, but may be either of them.

The image capturing section 1 is formed of an image sensor that can read by color or white and black, such as a CCD (charge coupled device) or a MOS (metal oxide semiconductor transistor), and the capturing principle of the image sensor is the same as a digital camera. As described later, since the eye "1" of the die usually has red color, use of an image sensor to enable the color image capturing is appropriate. However, since even in the image sensor in use for white and black, the red color is lighter reflected than the black color, or the eye "1" is usually different in size from the other eyes. This difference allows distinction between the eye "1" and the other eyes. Therefore, the image sensor for white and black may be used.

It is noted that in case a player is a student in the lower grades in an elementary school or a preschooler, it is thought that the player tends to bring his or her face close to the box 11 or looks in the box 11. On this occasion, it is predicted that the image-capturing section 1 shoots both eyes of the player and recognizes the two eyes for the eye number "2" in error. Therefore, the image-capturing section 1 is equipped with a lens with a bright release F-number to reduce depth of field, which allows only the dice to be clearly image-captured. Or an infrared sensor or the like may be disposed in the box 11 to detect that a player's face is coming close to the box 11 for emitting a warning.

In the image processing section 2, a digital processing of an image signal is carried out by the image-capturing section 1. The CPU 3 controls the entire apparatus, as well as processing shown in each flow chart as described later is carried out. The ROM 4 is a memory that stores programs for actuating the CPU 3 and can use a nonvolatile memory or a flash memory. The RAM 5 is a memory that temporarily stores setting values or processing results.

The display control section 6 performs control for displaying a determination result of the CPU 3. The display section 7 comprises a colored or a monochrome liquid crystal display, a cathode ray tube, and the like and displays the determination result with regard to the eye number made by the CPU 3. The audio processing section 8 performs voice synthesis of the determination result for outputting. The speaker 9 performs an electric-sound conversion with regard to an audio signal provided by the audio processing section 8 for outputting a voice.

The box 11 has an opening in an upper side thereof and has a transparent board 12 (transparent glass or transparent plastic) therein to divide the box 11 into two parts for forming an upper side and a lower side. A space above the transparent board 12 in the box 11 is a space for rolling dice. The image-capturing section 1 is installed on the bottom section. The image-capturing section 1 takes pictures of the lower faces of the dice 14, 15 as a captured image. Accordingly, when it is dark in the box 11, a clear picture can not be taken. Therefore, the box 11 is formed of a transparent plastic or glass, or a lamp for illumination is disposed in the vicinity of the image-capturing section 1 inside the box 11. Or an electronic flash (strobe) that momentarily emits light only in capturing an image may be used as a light source.

Further, a reset switch 13 hangs at a position within a player's reach on an outer wall of the box 11. The reset switch 13 is operated for clearing the previous determination result in a case the dice 14, 15 (or one of them) are thrown after the dice have been rolled and the determination of the eye number for the dice have been made.

FIG. 1, when a player throws both dice 14, 15 or one of them inside the box 11, the dice 14, 15 rolled on the transparent board 12 stop with time. The lower faces of the dice 14, 15 after stoppage are captured by the image-capturing section 1. The captured image is inputted in the image processing section 2, which is converted to a signal format that can be processed by the CPU 3. An image signal by the image processing section 2 is stored in the RAM 5 under control of the CPU 3. The CPU 3 checks image contents of the image processing section 2 according to the program of the ROM 4, to determine which of "1"-"6" the eye number on the dice 14, 15 is.

The determination result is displayed in numbers on a screen of the display section 7 through the display control section 6. Further, the determination result is outputted in a voice with voice synthesis by the audio processing section 8 and the speaker 9. In this case the audio output is performed only one time for one determination result, and the display on the display section 7 continues to be made until the next image capture timing.

Figure 2:
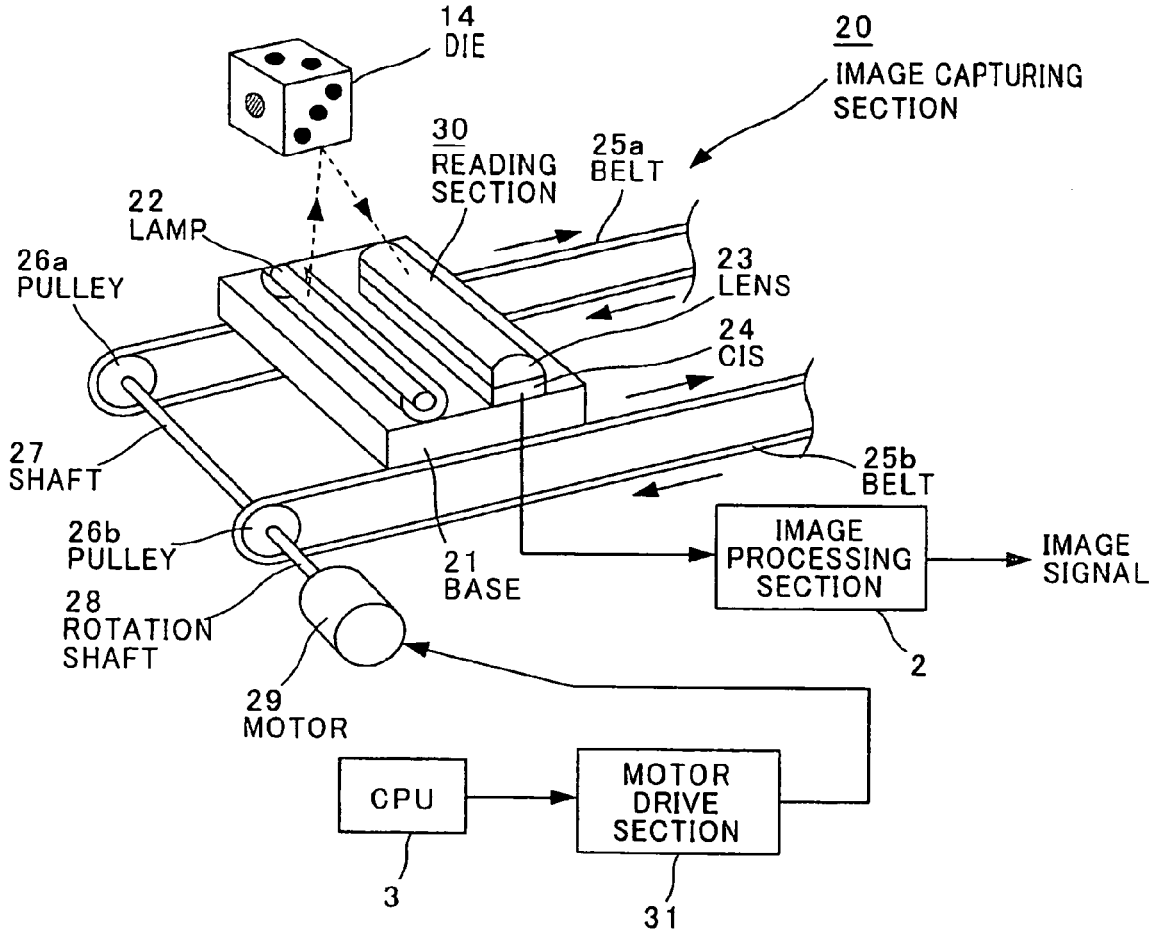
FIG. 2 is a frame constitution view showing another example of an image-capturing section.

FIG. 2 shows another constitution example of an image-capturing section. The image-capturing section 20 is formed in a scanner principle known as a peripheral device of a personal computer, and disposed under the lower face of the transparent board 12 (on the bottom face of the box 11). The image-capturing section 20 comprises a base 21 reciprocating in the lower face of the transparent board 12, a lamp 22 (a fluorescent lamp, a white LED, or the like) for illumination, a reading section 30 composed of a lens 23, and a CIS 24 (Contact Image Sensor) and disposed in parallel to the lamp 22, belts 25*a*, 25*b* to reciprocate the base 21 under the lower face of the transparent board 12, pulleys 26*a*, 26*b* to rotatably support end sections of the belts 25*a*, 25*b*, a shaft 27 connecting the pulleys 26*a*, 26*b*, a motor 29 connected to the shaft 27 through a rotation shaft 28, and a motor drive section 31 to drive the motor 29 under control of the CPU 3.

It is noted that a chain may be used in place of the belts 25*a*, 25*b* where a chain gear is used in place of the pulleys 26*a*, 26*b*. And a CCD image sensor may be used in place of the CIS 24. In the case of using the CCD image sensor, an optical system as another example is adopted where a reflected image from a reading face is introduced through one or a plurality of mirrors and further through an imaging lens to the CDD image sensor.

In FIG. 2, when the motor drive section 31 is driven under the control of the CPU 3, power is supplied to the motor 29. The pulleys 26*a*, 26*b* are rotated by rotation of the motor 29 and the belts 25*a*, 25*b* are rotated and at the same time the light 22 is switched on. The base 21 travels by rotation of the belts 25*a*, 25*b*. As the base 21 travels, the surface of the transparent board 12 is continuously illuminated by an area corresponding to the lamp length and a predetermined width by the lamp 22. The die 14 is illuminated by this illumination and the reflected light from the lower face of the die 14 is read in the reading section 30 and is supplied to the image processing section 2.

The image-capturing section 1 in FIG. 1 has the advantages that the number of the components is reduced and other than that, time required for image inputs is shortened since mechanical, movable parts are not used for image-reading. However, since a lens for imaging is used, extension of an image-receiving range lengthens a distance from a tip end of the image-capturing section 1 to the transparent board 12, namely heightens a location position of the transparent board 12 and as a result, it is difficult to reduce the entire height of the box 11. On the other hand, in the image-capturing section 20 in FIG. 2, the number of the components is increased, but since the thickness (height) of the image-capturing section 1 can be reduced, the location position of the transparent board 12 can be lowered. However, since the image-capturing section 20 performs the reading by traveling the reading section 30, image-reading takes more time as compared to the image-capturing section 1.

It is noted that the eye number is outputted such that the box 11 is stationary on a desk or a tatami mat and the die is rolled on it, but the box 11 may be moved with the die still put inside the box 11. In this case if the opening of the box 11 is wide, the dice tend to jump out of the box 11. Accordingly, it is preferable that a size of the opening of the box 11 is so small as to take in/out the dice and further, an entire weight of the box 11 is reduced.

And as in FIGS. 1 and 2, when the dice 14, 15 are image captured from the lower face side thereof, since a player who has rolled the die looks at the upper face of the die 14, a difference in the eye number between the image captured lower face and the upper face occurs. Therefore, it is necessary to correct a numerical value obtained by image capturing the lower face with the eye number of the upper face. Namely a calculation of "7—an image capturing value" may be performed. For example, when a value obtained by image capturing the lower face of the die 14 is "6", the eye number of the upper face of the die 14 is admitted as "1", and likewise when a value obtained by image capturing is "2", the eye number of the upper face of the die 14 is admitted as "5". However, the eye number of the lower face may be the eye number as it is and in particular in case a box in which an upper face of the die cannot be seen from an outside of the box is used, it is preferable that the eye number of the lower face is determined as the eye number as it is, in view of no necessity of the above calculation.

Figure 3:
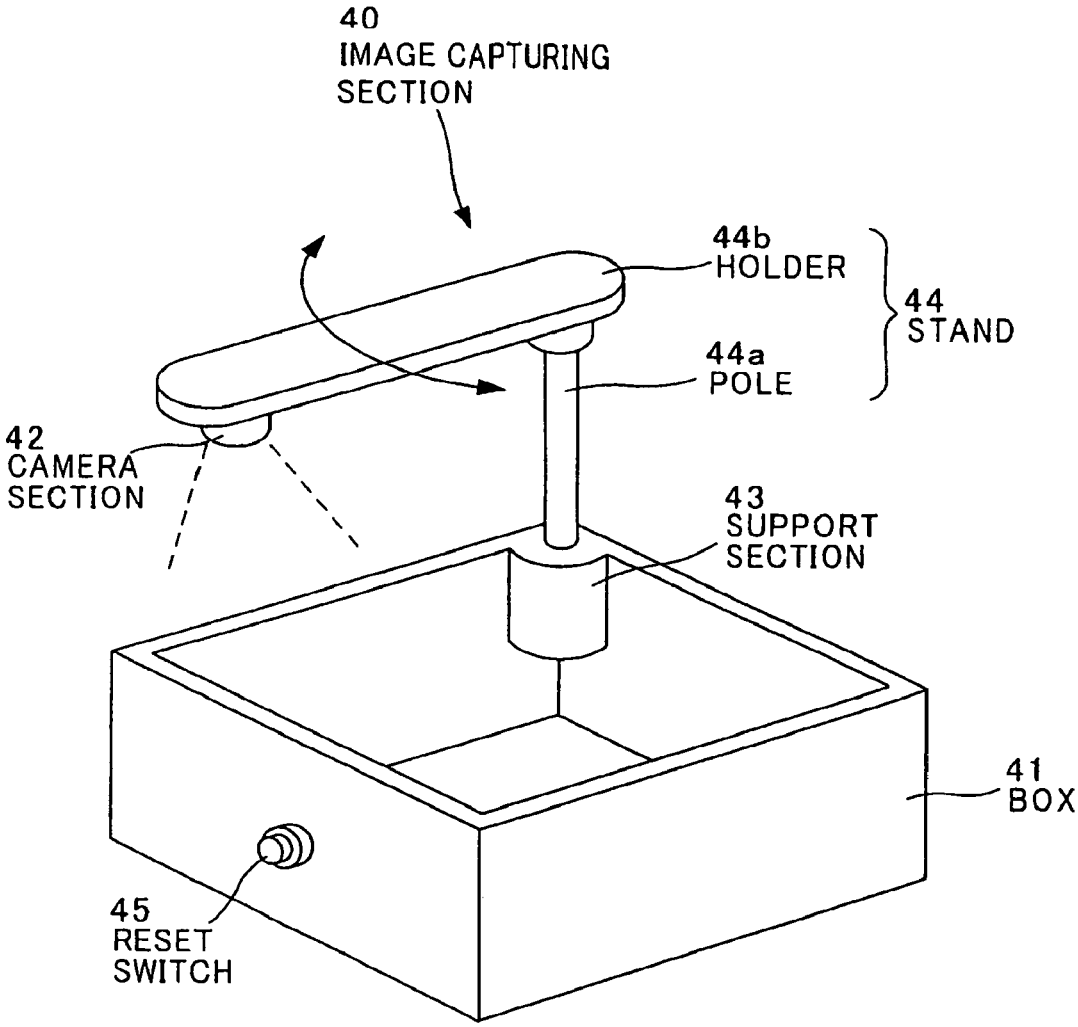
FIG. 3 is a frame constitution view showing a different example of an image-capturing section.

FIG. 3 shows a further example of an image-capturing section. An image capturing section 40 is adapted to image-capture the die from above the box 41, as well as rotate a camera section 42 corresponding to the image-capturing section 1 in FIG. 1 within an angle of at least 45° and further retreat the camera section 42 from the box 41 when unnecessary.

A support section 43 is formed in one corner of the box 41 and a stand 44 is rotatably mounted and movable upward and downward to the support section 43. The stand 44 comprises a round rod shaped pole 44*a*, and a holder 44*b* that is mounted horizontally and rotatably at an upper end of the pole 44*a*. The holder 44*b* can be rotated horizontally with a hand and a tip of the holder 44*b* is moved from one section of the box 41 to a center of the box 41. The tip of the holder 44*b* is positioned to be above the center of the box 41 when the camera section 42 captures the image of the dice 14, 15 or the like.

The camera section 42 is mounted to a tip of the holder 44*b*. The camera section 42 is formed of a camera, such as a combination of an optical lens and an image-capturing element of CCD or MOS and a lens, or a combination of the image-capturing element and the lens, further including an image processing section, and can take a picture of an entire bottom face of the box 11 within vision's field. Pushing an upper portion of the pole 44*a* causes the height thereof to be lowered, and lifting up the pole 44*a* causes the position of the holder 44*b* to be raised. And a reset switch 45 having the same effect with the reset switch 13 in FIG. 1 is mounted to the side face of the box 41.

Figure 4:
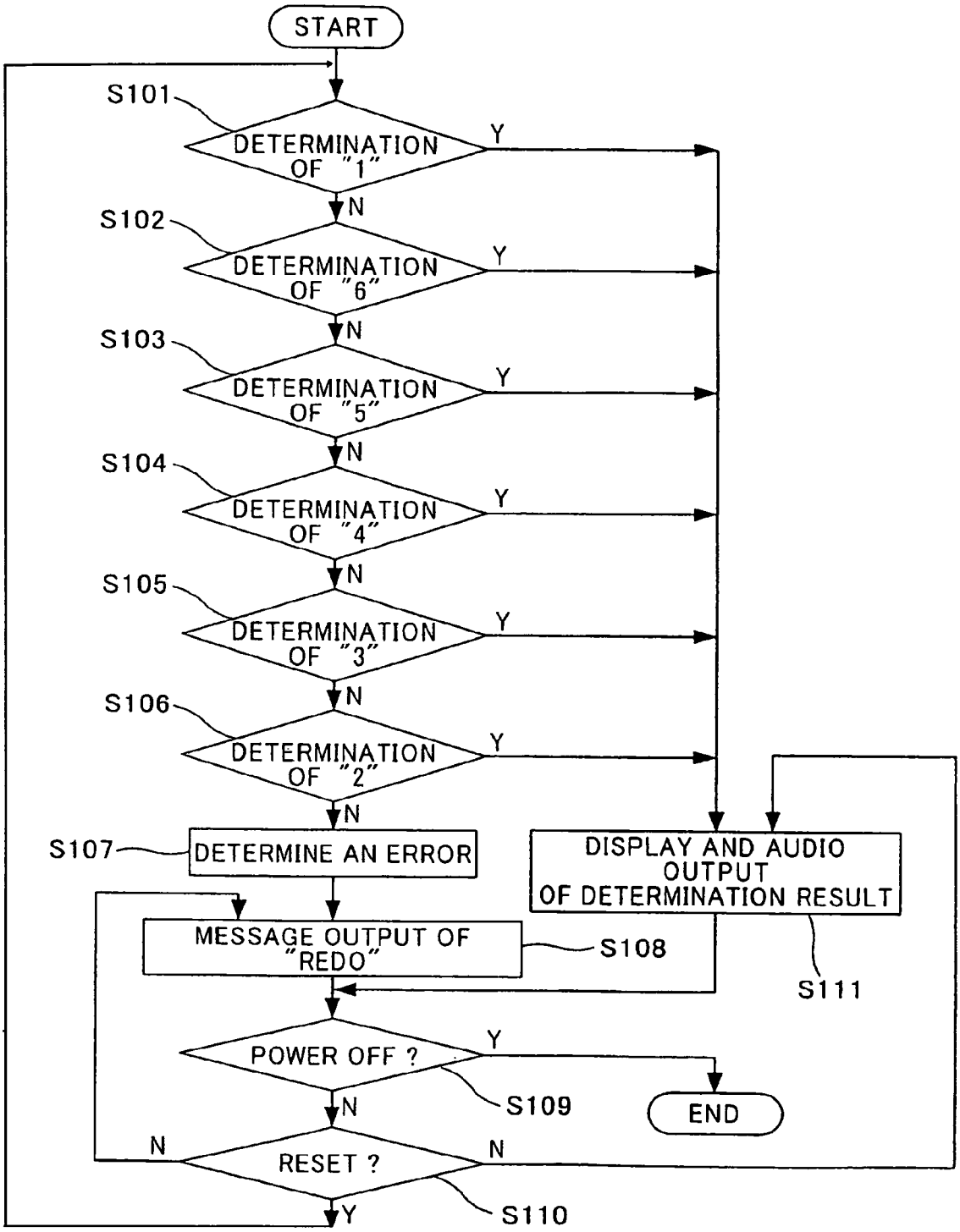
FIG. 4 is a flow chart showing an entire processing of an eye number determination method for a die in the first preferred embodiment according to the present invention.

FIG. 4 shows an entire processing of a die eye number determination method in the first preferred embodiment according to the present invention. Processing contents shown in FIG. 4 are stored as programs in the ROM 4. And in the following explanation an eye number determination is made using the die eye number determination apparatus method 10 shown in FIG. 1. Note that "S" shown in the flow charts in the following figures including FIG. 4 indicates "step".

In the first preferred embodiment according to the present invention, the eye number determination is made by two steps as described below. The first step is to extract eyes of the dice from an image. The second step is to determine an eye number of the dice from a location relation or the like of the extracted eyes. Namely the eye number is determined based upon detection information such as a location relation, diameters or colors of the eyes. A die is usually expected to have a clear contrast in a density (color) between the face and the eye of the die and therefore, the eye can be extracted based upon distribution and inclination of density values. Such processing enables the eye number determination even when the boundary between closely placed dice is not distinct due to low resolution caused by low contrast in brightness or color between the face of the die and the background thereof.

When the die eye number determination apparatus 10 shown in FIG. 1 starts to operate, and the initialization (the same as the state where the reset switch 13 is pushed) is performed. Then a player throws a plurality of dice into the box 11. One of two dice 14, 15, both thereof, or more than two can be used, and herein two dice 14, 15 are supposed to be used where the eye number is a lower face of each dice 14, 15. When the dice 14, 15 are thrown into the box 11, the dice 14, 15 are rolled and traveled on the transparent board 12, and stop. The lower faces of the dice 14, 15 after the stopping are captured by the image-capturing section 1. The CPU 3 performs processing according to FIG. 4 based upon image information by the image-capturing section 1, and determines which one of "1", "6", "5", "4", "3", and "2" the eye number of each dice 14, 15 is.

The image-capturing by the image-capturing section 1 is performed by scanning the transparent board 12 from one end toward the other end thereof. Therefore, in case two dice 14, 15 are aligned in the direction of the sub scanning, the eye number is determined for the die image captured first, and then, for the die image captured subsequently. And in case two dice 14, 15 are aligned in the direction of the main scanning, the eye number determination is thus made in order of scanning.

However, when the two dice 14, 15 stop to be close with each other, a determination error of the eye number tends to occur. According to the first preferred embodiment, it is desired that a determination is not made in order of the dice scanned, but an entirety of two dice is scanned as one image, and then a determination of the eye number is designed to be made.

The determination of the eye number is made by recognizing the number (at least one eye, and at maximum six eyes) of eyes existing in a predetermined area. However, there is a case where two dice happen to stop to be close with each other in case a plurality of dice are used, different from a case one die is used. For example, when the faces of the two dice showing the eye number "1" happen to be the lower faces thereof (namely, image-captured faces) at a time and then the two dice stop, the eye number tends to be determined to be "2" as the eye number of the one die in error without recognizing the eye number of each die as "1", or tends to recognize the eye to be a part of the other eye number in error. Therefore, in the first preferred embodiment according to the present invention, the following method is applied in the case of the eye number determination.

It is required that the eye number "1" is determined first and then is excluded before determination of other eye numbers is made. Excluding the eye number "1" first prevents the eye "1" from being recognized as a part of a pattern of the other eye number in error. A die available in the market has the feature that the eye "1" is larger in size than the eyes of the other eye numbers, and is colored in red. Accordingly when the red color is i and will included in the image-capturing information by the image-capturing section 1, it is determined immediately that the eye number of the die is "1" (S101).

Since a die does not have a unified standard in the industry organization, there is a slight difference in an outer size of the die or an eye size of the die between manufacturers. And there is a case the eye "1" is colored in black. Therefore, the eye number "1" is designed to be determined based upon anything other than colors. For example, in case the eye "1" is colored in black and a size of the die is limited to a certain degree, the eye number "1" is determined not based upon the color of the eye but based upon a diameter of the eye, or the eye number is determined as "1" if the distance of the eye to the nearest eye is longer than one section out of the four sections of the die.

In a case the eye number "1" is determined, the CPU 3 controls the display control section 6 to display the number "1" on the display section 7, as well as outputs a voice corresponding to "1" through the speaker 9 (S111). And in a case the eye number "1" is not determined, a determination of the eye number "6" is made (S102). In a case the eye number "6" is determined, the eye number "6" is displayed on the display section 7 and further, is outputted as a voice. In a case the eye number "6" is not determined, a determination of the eye number "5" is made (S103). The eye numbers "4", "3", and "2" are determined in order in the same way as the above (S104, S105, and S106). In a case the eye number is not determined even in S106, it is possible not to obtain clear captured images because of problems with a location of the box 11, existing positions of the dice 14, 15, illumination conditions, and the like. Accordingly, an error determination is made (S107) and a message to roll the dice 14, 15 once more is displayed or outputted in a voice (S108).

And it is detected whether or not power source of the die eye number determination apparatus 10 is switched off (S109). The power source of the die eye number determination apparatus 10 is switched off when the game is finished or a player becomes bored of the game half way. Therefore, on/off of the power source is detected. In a case a player rolls the dice 14, 15 again according to the message S108, after the dice 14, 15 rolled previously are taken out of the box 11, the determination contents and the display state are cleared by pushing the reset switch 13. Herein, a player throws the dice 14, into the box 11. This action causes the eyes of the dice 14, 15 to newly capture the image by the image-capturing section 1. Thereafter, processing of S110-S111 is performed again as described above.

Figure 5:
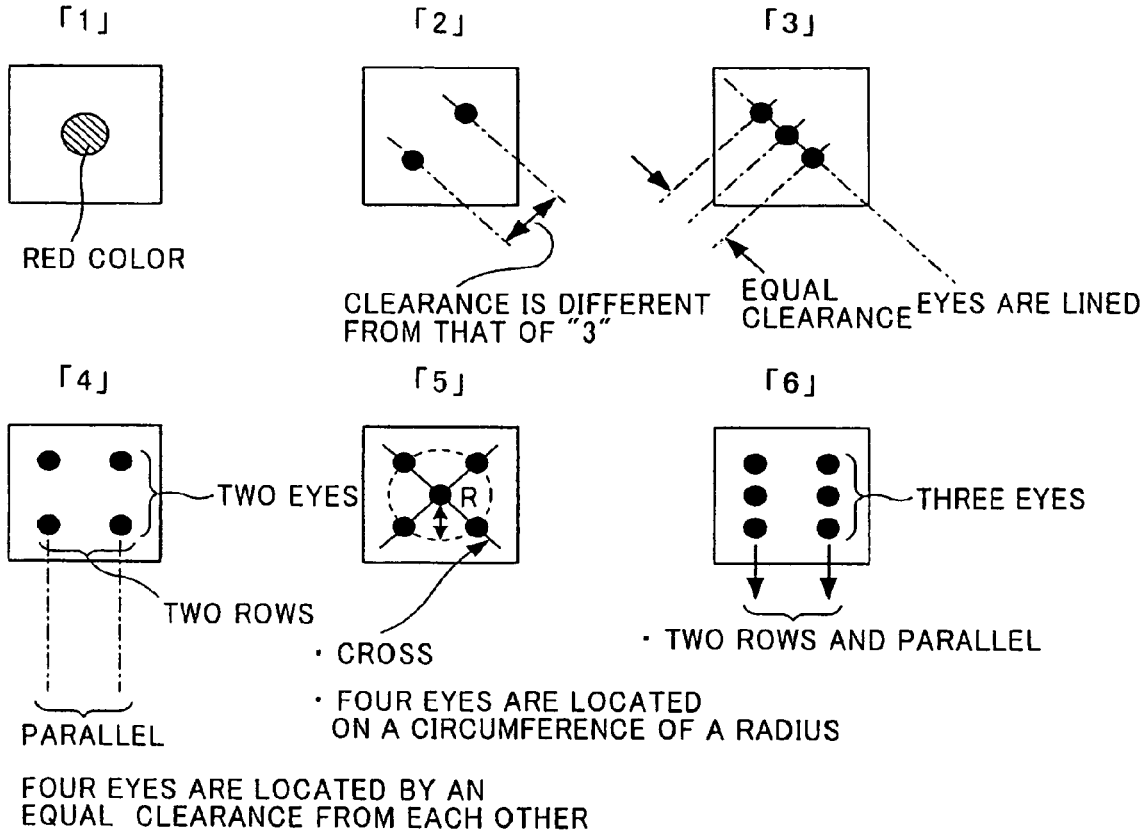
FIG. 5 is an explanation view showing how each of the eye number "1"-"6" of the die appears.

FIG. 5 shows featuring items of each eye as factors for determining the eye numbers of "1"-"6" for the die. Each eye can be distinguished using the featuring items to determine the eye number. As shown in FIG. 5, the one eye as the eye number "1" is different from the eyes of the other eye numbers and has the feature in color (red circle or the like) or in size (a diameter thereof is greater than that of the eyes of the other eye numbers). A clearance between the eyes of "2" is different from a clearance between the eyes of "3". The eye number "4" has two rows of two eyes, which are parallel with each other. The eye number "5" has five eyes located on the face to form the cross, and also the four eyes are located on a circumference of the same radius away from the center eye. Further, the eye number "6" has two rows of three eyes, and the two rows are parallel. The processing as explained below is performed based upon such feature with regard to the locations of the respective eyes of the die.

Figure 6:
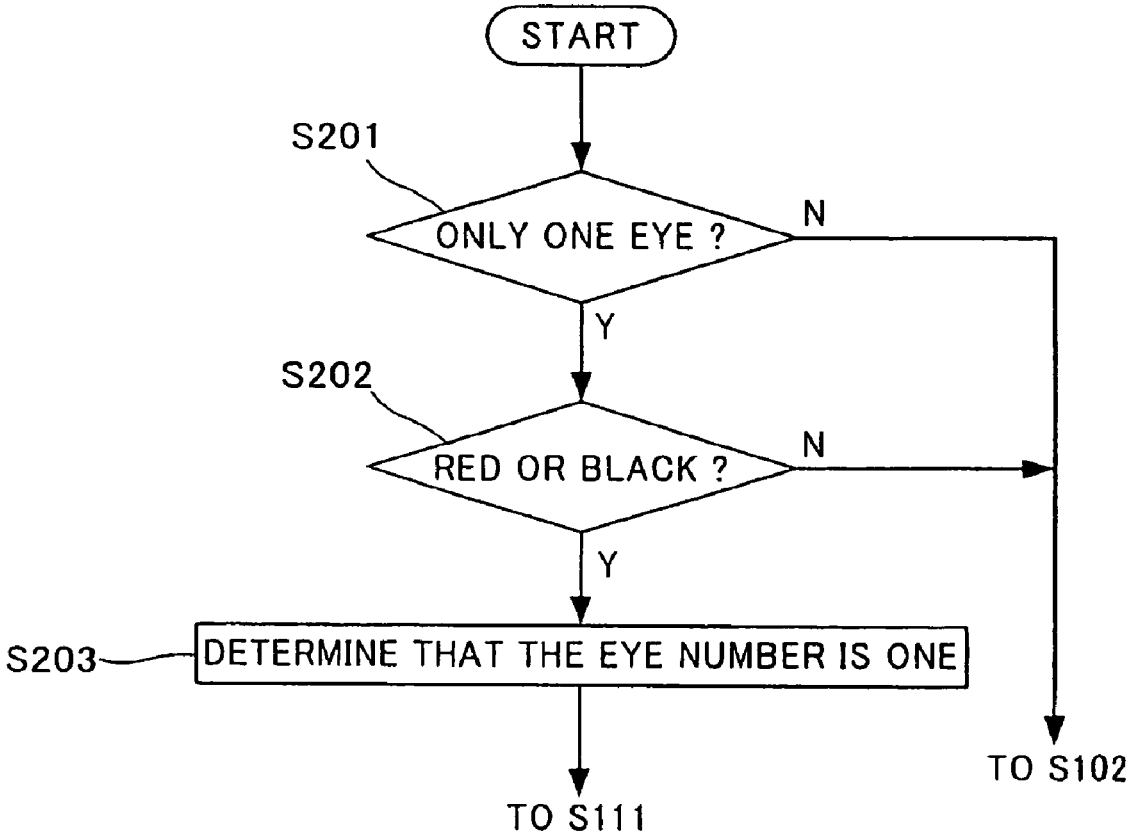
FIG. 6 is a flow chart showing a detailed processing in S101 in FIG. 4.

FIG. 6 shows a detailed processing of S101. When it is determined that the eye of the die is one red eye or one black eye (S201, S202), it is determined that the eye number is "1" (S203) and thereafter, the processing goes to S111. And when it is not determined that the eye number is "1", the processing goes to S102 in FIG. 1.

Figure 7:
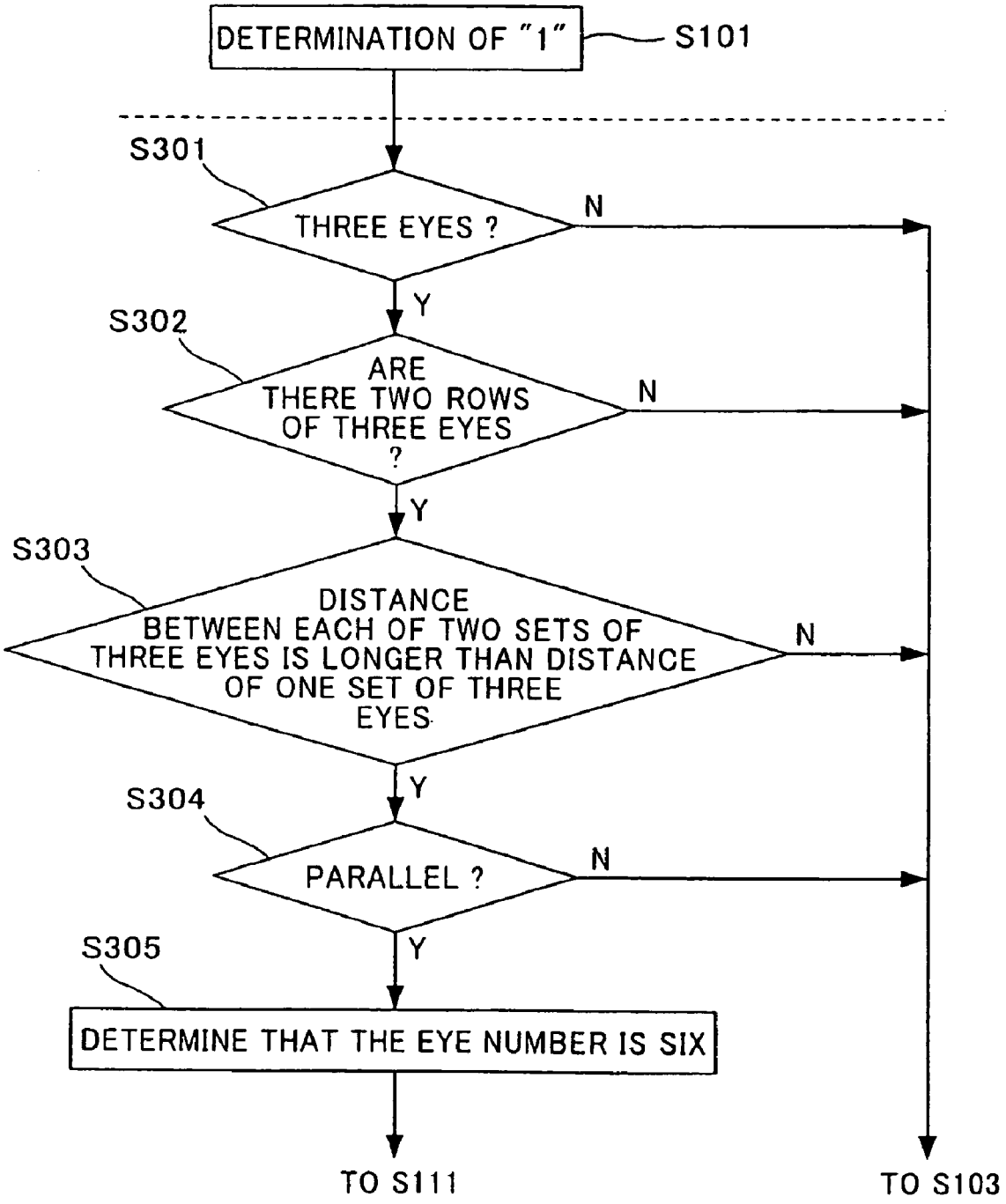
FIG. 7 is a flow chart showing a detailed processing in S102 in FIG. 4.
Figure 8A:
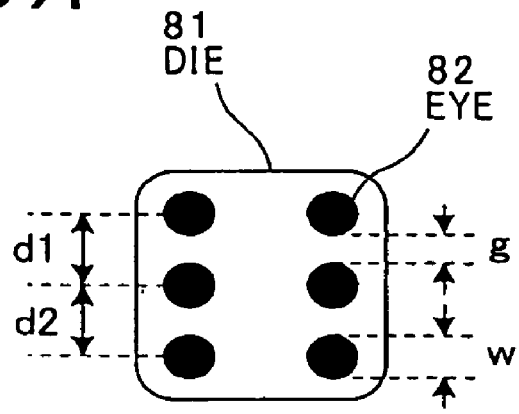
FIG. 8A is an explanation view showing detailed location of each eye of the eye number "6" on the die.
Figure 8B:
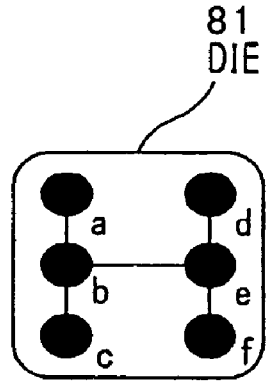
FIG. 8B is an explanation view showing detailed location of each eye of the eye number "6" on the die.
Figure 8C:
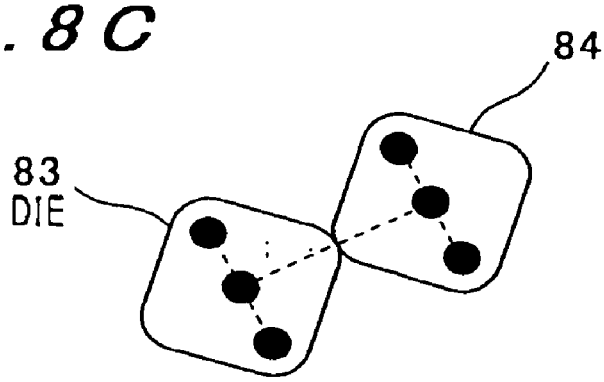
FIG. 8C is an explanation view showing detailed location of each eye of the eye number "3" on the die.
Figure 8D:
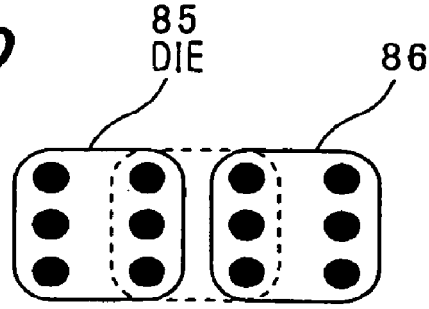
FIG. 8D is an explanation view showing detailed location of each eye of the eye number "6" on the die.

FIG. 7 shows a determination processing of the eye number "6". And FIGS. 8A, 8B, and 8D show a detailed location of each eye of the eye number "6" and FIG. 8C shows a location of the eye number "3". In the eye number "6" of the die as shown in FIGS. 5 and 8, three eyes are closely in a line and two sets of the three eyes are located in two rows. As shown in FIG. 8C, there possibly occurs the event that the eye numbers of two dice 83, 84 both are "3" and the two dice are closely in aligned. In this case, it is determined whether or not a distance between each three eyes of one set and each corresponding three eyes of the other set is shorter than a length of the one set (the length formed by three eyes).

And in a case the two dice 85, 86 are contacted in a line, each showing the eye number "6" as shown in FIG. 8D, it is possible that three eyes of the one die and the neighboring three eyes of the other die are recognized to be the eye number "6" in error. In order to avoid such erroneous recognition, the sets of the three eyes image captured are not set at random, but set for example in order from the left to the right and thereafter, the other eyes in the right and the left direction are determined.

With regard to the condition in order that a set of three eyes is determined to be "6" as the eye number, as shown in FIG. 8A, three eyes 82 of the die 81 are in a line and a distance "d1" between the one and the center eye is equal to a distance "d2" between the other and the center eye (d1 is nearly equal to d2), and also the three eyes are very closely positioned. A clearance "g" between an eye and an eye is usually small than a diameter "w" of the eye (g<w) and each of the distance "d1" and the distance "d2" is less than twice the diameter of the eye (a distance "d" of the die available in the market is mostly approximately 1.74 w). Next a determination processing of the eye number "6" will be explained with reference to FIG. 7.

First, it is determined whether or not three eyes exist (S301) and next it is determined whether or not two sets of the three eyes is located in two rows (S302), and then it is determined whether or not a distance between each of the three eyes is longer than a length of one set of the three eyes (S303). Further, it is determined whether or not the two rows are in parallel and also square with respect to each other (S304).

Further, the determination of the eye number "6" is made such that when the plurality of the dice are located together to form the eye number "6" with three eyes and three eyes adjacent to the three eyes, it is determined whether or not the formed eyes are the correct eye number "6" based upon a clearance between the central eyes or an eye existing in the direction different from the location direction of the three eyes.

In a detail, as shown in FIG. 8B, it is determined whether or not the line of the eyes "a"-"c" is parallel to the line of the eyes "d"-"f", as well as the line of the eyes "a"-"c" (or "d"-"f") is substantially vertical to the line of the eyes "b"-"e" (or, the eyes "a"-"d" or the eyes "c"-"f"). Or it may be determined whether or not the line of the eyes "a"-"c" the same in length as the line of the eyes "d"-"f". And it is determined whether or not the line of the eyes "b"-"e" is longer than the line of the eyes "a"-"c" or the line of the eyes "d"-"f" so that a state where two dice each having the eye number "3" are placed parallel to each other is not recognized in error to be the eye number "6". In a case the line of the eyes "b"-"e" is longer than the line of the eyes "a"-"c" or the line of the eyes "d"-"f", it is determined that the eye number is not "6". It is noted that the line of the eyes "a"-"c" or the like indicates a distance or a length between two eyes ("a" and "c").

FIG. 8D shows a case where two dice 85, 86, each having the eye number "6" are adjacently and also in the same direction placed. In this case it is possible to recognize the eye number "6" with a combination of three eyes of one die and three eyes of the other die. Accordingly, in coping with this problem, sets of three eyes image captured are set not at random, but in order from the right to the left.

According to the determination processing described above, the eye number "6" can be recognized. If the determination of the eye number "6" is made prior to determination of the other eye numbers, loads in the subsequent determination processing are reduced, which enables earlier finish of an entire determination processing.

In a case the above three conditions are cleared, the eye number "6" is determined (S305), the processing goes to S111 in FIG. 1. And in a case even one of the three conditions is not cleared, the eye number "6" is not determined and the processing goes to S103 in FIG. 1. The earlier determination of the eye number "6" in FIG. 7 brings out reduction of loads in subsequent processing, thereby to provide earlier finish of an entire processing in FIG. 4.

Figure 9:
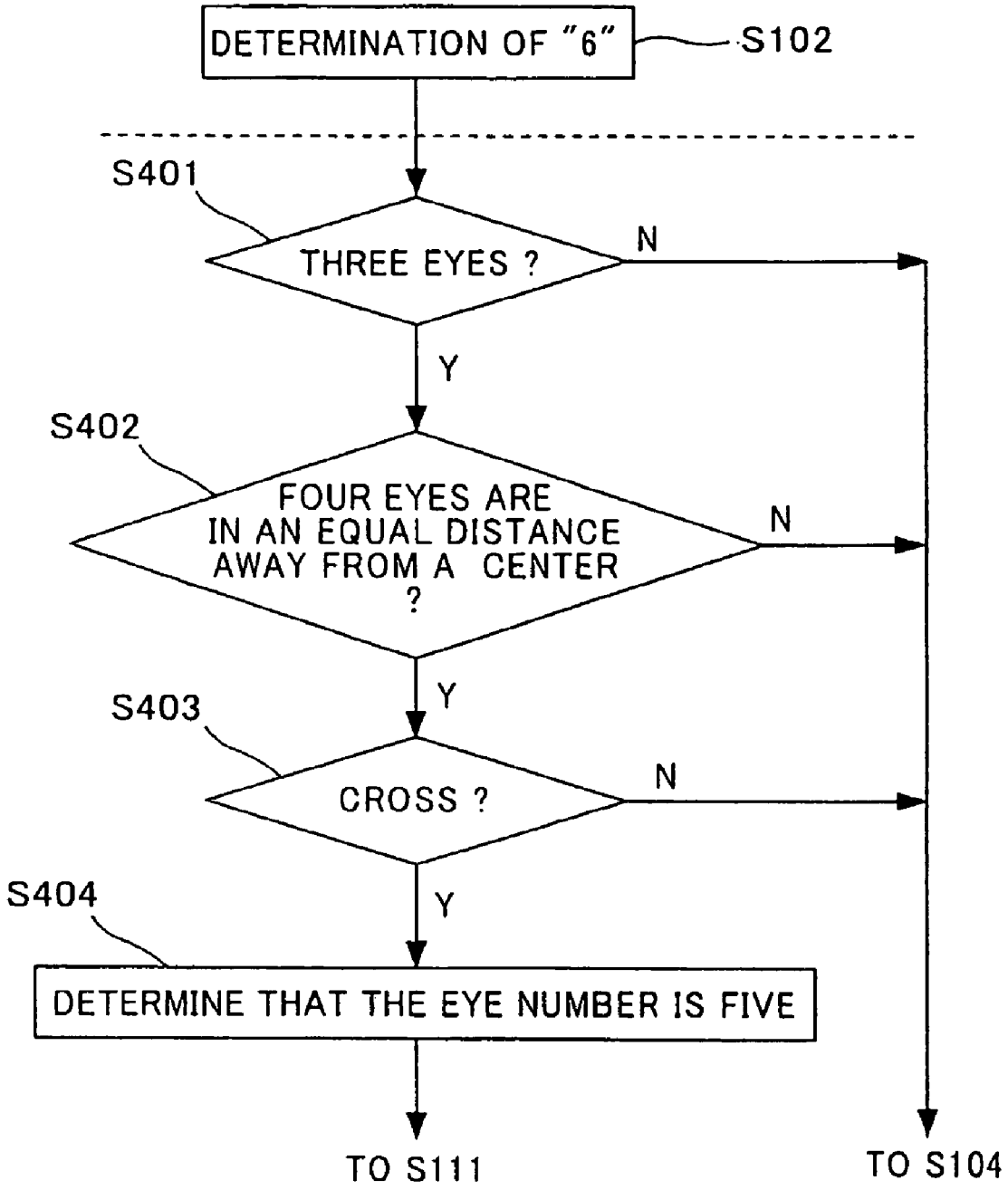
FIG. 9 is a flow chart showing a detailed processing in S103 in FIG. 4.

FIG. 9 shows a determination processing of the eye number "5".

Figure 10:
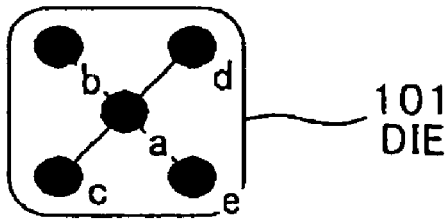
FIG. 10 is an explanation view showing detailed location of each eye of the eye number "5" on the die.

FIG. 10 shows a location of the eyes of the eye number "5" on die 101. In the eyes of the eye number "5", as shown in FIGS. 5 and 10, four black eyes are located on the four corners of a quadrangle and one black eye is located in the center thereof. In other words, since the black eyes are located on a cross, it is determined that the eye number is "5" depending on whether or not the five black eyes are located on a cross. According to further consideration, in the eye number "5", four black eyes surrounding the black eye in the center are in the same distance away therefrom. Accordingly it is the condition for the determination of the eye number "5" whether or not the black eyes are located on the cross and the four black eyes are located in the same distance away from the center.

First, it is determined whether or not the number of black eyes is three (S401). This processing is because of recognition for the center of the cross. In a case three black eyes exist, it is determined whether or not four black eyes are located in the same distance away from the center of the three eyes (S402). Next, in a case four black eyes exist in the same distance away from the center, it is determined whether or not the black eyes are located on the cross (at right angles) as a whole (S403).

Namely the eye number "5" is determined based upon whether or not five eyes shown in FIG. 10 have the relation as shown below.

$$|\text{“}a\text{”}-\text{“}b\text{”}|\approx|\text{“}a\text{”}-\text{“}c\text{”}|\approx|\text{“}a\text{”}-\text{“}d\text{”}|\approx|\text{“}a\text{”}-\text{“}e\text{”}| \text{(equal clearance)}$$

$$(\text{“}b\text{”}-\text{“}e\text{”}\cdot\text{“}c\text{”}-\text{“}d\text{”})/(|\text{“}b\text{”}-\text{“}e\text{”}|\cdot|\text{“}c\text{”}-\text{“}d\text{”}|)\approx 0 \text{(vertical crossing)}$$

In a case the above condition is cleared, it is determined the eye number is "5" (S404), the processing goes to S111 in FIG. 1. And in a case even one of the three conditions is not cleared, it is not determined that the eye number is "5", and the processing goes to S104 in FIG. 4. It is noted that the determination of the eye number "5" is made based upon the condition that any eye of the five eyes does not have the feature of the eye number "1". However, if the determination of the eye number "1" is, as shown in FIG. 4, made before the determination processing of the eye number "5", the processing of this confirmation is not necessary.

Figure 11:
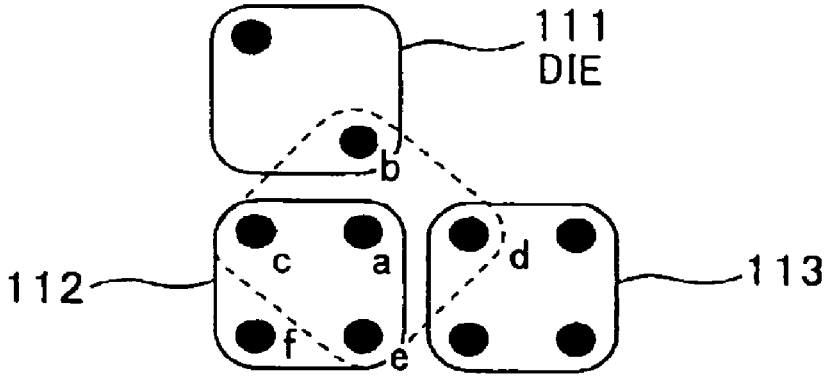
FIG. 11 is an explanation view showing a state where three dice of the eye numbers "2", "4", and "4" are put together to falsely form the eye number "5"

FIG. 11 shows a case where three dice 111, 112, and 113 stop in a collective state, as well as the eye numbers thereof become respectively "2", "4", and "4". In this case the eye number "5" is formed in the center of the three dice as shown in a dotted line. The processing of this case will be explained as below.

Since an eye number pattern of "5" in this case is larger in size than an actual die, it is determined that the eye number is not "5", and this pattern can be excluded from the determination results. It is noted that there is a method of determining that the eye number is not "5" based upon the condition except for the size of the die. Namely it is determined based upon whether or not an eye "f" forming a part of an eye number pattern of "4" exists in the vicinity of the die 112 having the eyes "a", "c", and "e" of the eye number "5".

If the eye "f" is found, it is assumed that the eye number shown in a dotted line by the five eyes "a", "b", "c", "d", and "e" is not "5". The reason is that if the eyes "a", "b", "c", "d", and "e" are the eyes of the eye number "5" of the die, the eye "f" does not come close to the dotted line showing the border. The inventors have confirmed that this respect is correct by checking various kinds of dice available in the market.

It will be confirmed by the above similar method whether or not another eye (for example, having the feature similar to the eye "f") exists in the other three eye number patterns of the eyes "a", "b", and "c", the eyes "a", "b", and "d", and the eyes "a", "b", and "e". For example, whether or not the other eye is paired to the eyes "a", "c", and "e" to form the eye number pattern of "4" can be determined based upon whether or not a set of the eyes "a"-"the other eye" is substantially as long as a set of the eyes "c"-"e", and also each set is crossed in the vicinity of respective centers.

The eye number "5" can be recognized by the determination processing described above. An earlier determination of the eye number "5" causes easier processing of subsequent other eye number determinations to shorten finish time of an entire processing. And the eye number determination of "5" can be incorporated in a method of "the processing starts with an end eye" described later. In this case, with no possibility of erroneous recognition of the eye number "4" of the die, the determination processing of the eye number "5" becomes simple.

Figure 12:
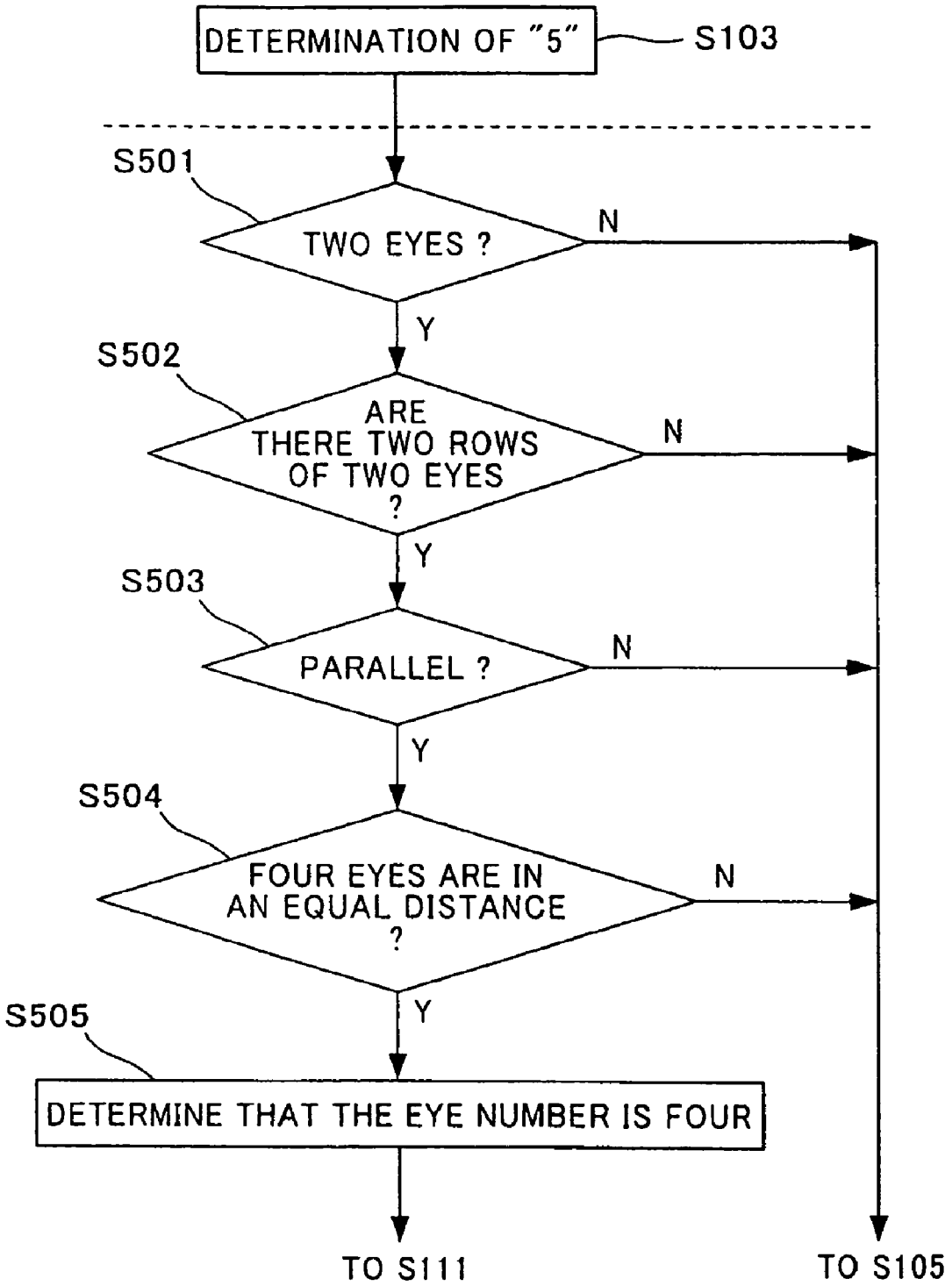
FIG. 12 is a flow chart showing a detailed processing in S104 in FIG. 4.

FIG. 12 shows a determination processing of the eye number "4". In the eye number "4", as shown in FIG. 5, four black eyes are vertically arranged. Accordingly when the four black eyes exist, the eye number "4" is nearly determined. According to further consideration, if in four eyes, two lines, each connecting two black eyes, are respectively crossed vertically, and each line has substantially the same and appropriate length, and the crossing point of the two lines is in the vicinity of the respective centers, it is found that the eye number is "4". And there is a possibility that two eyes of the two dice come close to seemingly form the eyes "4". Accordingly whether or not the four black eyes are located in an equal distance is also included in the determination condition.

First, it is determined whether or not the number of the eyes of the die is two (S501). Next, it is determined whether or not there are two rows of two eyes (S502). The four eyes to show the eye number "4" is recognized based upon this determination. Next, it is determined whether or not two rows of the two eyes are parallel (S503), and further, it is determined whether or not each of four eyes is mutually in an equal distance from two eyes adjacent thereto (S504). When each condition described above is cleared, it is determined that the eye number is "4" (S505), the processing goes to S111 in FIG. 1. On the other hand, when even one of the four conditions is not cleared, it is not determined that the eye number is "4", and the processing goes to S105 in FIG. 1.

Figure 13:
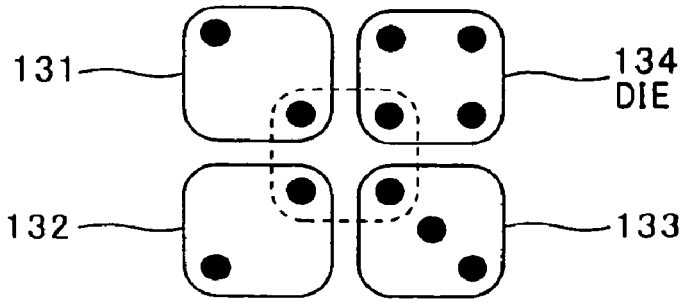
FIG. 13 is an explanation view showing a state where a plurality of dice are put together to form the eye number "4"

FIG. 13 shows a case where a plurality of dice are rolled to be placed in a collective state to form the eye number "4" in the center. As an example to form such eye number pattern, there is a case four dice 131, 132, 133, and 134 are located in a collective state to form a quadrangle as a whole, and the respective eye numbers are shown as "2", "2", "3", and "4". In this case the eye number "4" is formed in the center as shown in dotted line. Since in this case, not only the eye number "4" but also the other eye number patterns such as the eye numbers "2", and "3" are possibly determined, the eye numbers can not be simply determined unlike the eye number "6" or "5" described above.

Therefore, based upon an eye in the outmost end in an image, an eye number of a die including the eye of the outmost end is processed by a method explained below.

This processing will be repeated by setting the eye existing in the outmost end in the image as a base point in order until an unprocessed eye does not exist. This allows the eye numbers "4"-"2" to be determined. It is noted that in the process of performing this processing, the determination of the eye numbers "1", "5", and "6" is possible to make. This processing will be explained in detail later.

This processing determines, based upon the eye existing in the outmost end in an image, that the eye number is "1", "6", "5", "4", "3", or "2". For example, a distance between the eyes is used for eye number determination. Since two eyes having the longest distance therebetween in the image are the eyes positioned in the outmost end in the image, it is all right only if the respective two eyes or either one of the two are processed. When the eye number with regard to eyes including an eye (first unprocessed end eye) existing in the outmost end in the image is determined and its processing is finished, the near unprocessed eye is set as an unprocessed end eye (second unprocessed end eye) and will be processed in order.

First, if the end eye unprocessed in the image has the feature of the eye "1" described above, the eye number is determined/confirmed as "1".

If recognition of the eye number "1" is finished, it is not necessary to determine a determination of the eye number "1" newly.

Next, it will be determined whether or not the eye number is "6". If the end eye unprocessed in the image is a part of the eye number "6", that part is the end eye in the three eyes closely placed in series in the eye number pattern of "6", and an eye closest to the end eye is a central eye of the three eyes. If the above eye number pattern of "6" corresponds to this state the eye number is determined to be "6". It is noted that herein the false eye number pattern "6" as shown in FIG. 8D is not necessary to consider. In this case, if the recognition of "6" is finished, it is not necessary to perform the determination of "6" newly.

Next, following the determination of whether or not the eye number is "6", it will be determined whether or not the eye number is "5". If the end eye unprocessed in the image is a part of the eye number "5", the end eye is any one of four eyes other than the central eye out of the pattern of "5", and the eye closest to the end eye is the central eye of the pattern "5". If the pattern of "5" corresponds to this condition, the eye number "5" can be determined. In this case, consideration of the false eye number pattern "5" as shown in FIG. 11 is not necessary, and a limit to a clearance between eyes may be set in accordance with a size of the die. In this case, if the recognition of the eye number "5" is finished, it is not necessary to perform a determination of the eye number "5" newly.

Next, it is performed to determine whether or not the eye number is "4". If the end eye "a" unprocessed, as well as the eyes "b", "c", and "d" forming the eye number pattern "4" exist in the image, the eye "a" is a part of the eye number "4" or "5". However, it is the condition that any eye does not have the feature of the eye number "1". It is noted that if the determination of "1" is determined in advance, this determination is not necessary.

Figure 14:
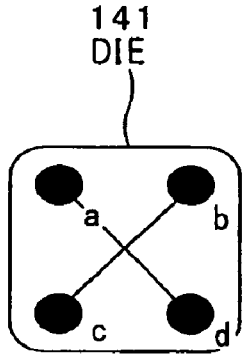
FIG. 14 is an explanation view showing an eye location in an eye pattern of the eye number "4" on the die.

FIG. 14 shows an eye location of the eye number pattern "4". In FIG. 14, whether or not four eyes of the die 141 show the eye number pattern "4" can be determined based upon the following equation.

Condition 1: |"a"−"d" |≈|"b"−"c"|

Condition 2: ("a"−"d"·"b"−"c")/(|"a"−"d"|·|"b"−"c"|)≈0 (vertical crossing)

Condition 3: A line component "ad" and a line component "bc" are crossed respectively in the vicinity of the center of each line.

Further, it is predicted that a plurality of dice are collected to form the eye number "4".

Figure 15:
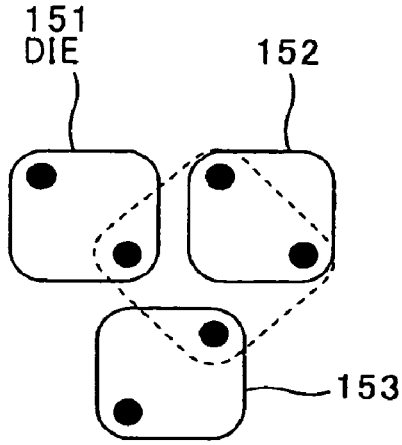
FIG. 15 is an explanation view showing a state where three dice, each having the eye number "2", are put together to form the eye number "4"

FIG. 15 shows a case where three dice 151, 152 and 153, each having the eye number "2", are collected to form the eye number pattern "4". In order to exclude that the eye number "4" is determined in such case, a limit to a clearance between eyes is required to be set in accordance with the size of the die. For example, a size of the die used may be restricted to define a certain value to the limit or the limit may be changed based upon a diameter or the like of the eye.

If the eyes "a", "b", "c", and "d" meet the above conditions 1-3, the eyes "a", "b", "c" and "d" can be assumed to be a part of the eye number "4" or "5". Accordingly in a case it will be determined whether or not the eye number is "4" after it is determined whether or not the end eye "a" is a part of the eye number "5", since at this timing the eye number is never "5", it can be determined immediately that the eyes "a", "b", "c" and "d" is the part of the eye number "4". Or it may be checked whether or not another eye exists inside the eyes "a", "b", "c" and "d".

When the end eye "a" unprocessed in the image does not correspond to anyone of the determination conditions of the above-mentioned eye numbers "6", "5", and "4", the eye number may be assumed to be the eye number "3" or "2". Namely if an eye forming the eye number pattern "3" together with the end eye "a" and the eye "b" closest to the end eye "a" exists, the eyes "a", "b", and "c" are a part of the eye number "3".

Figure 16:
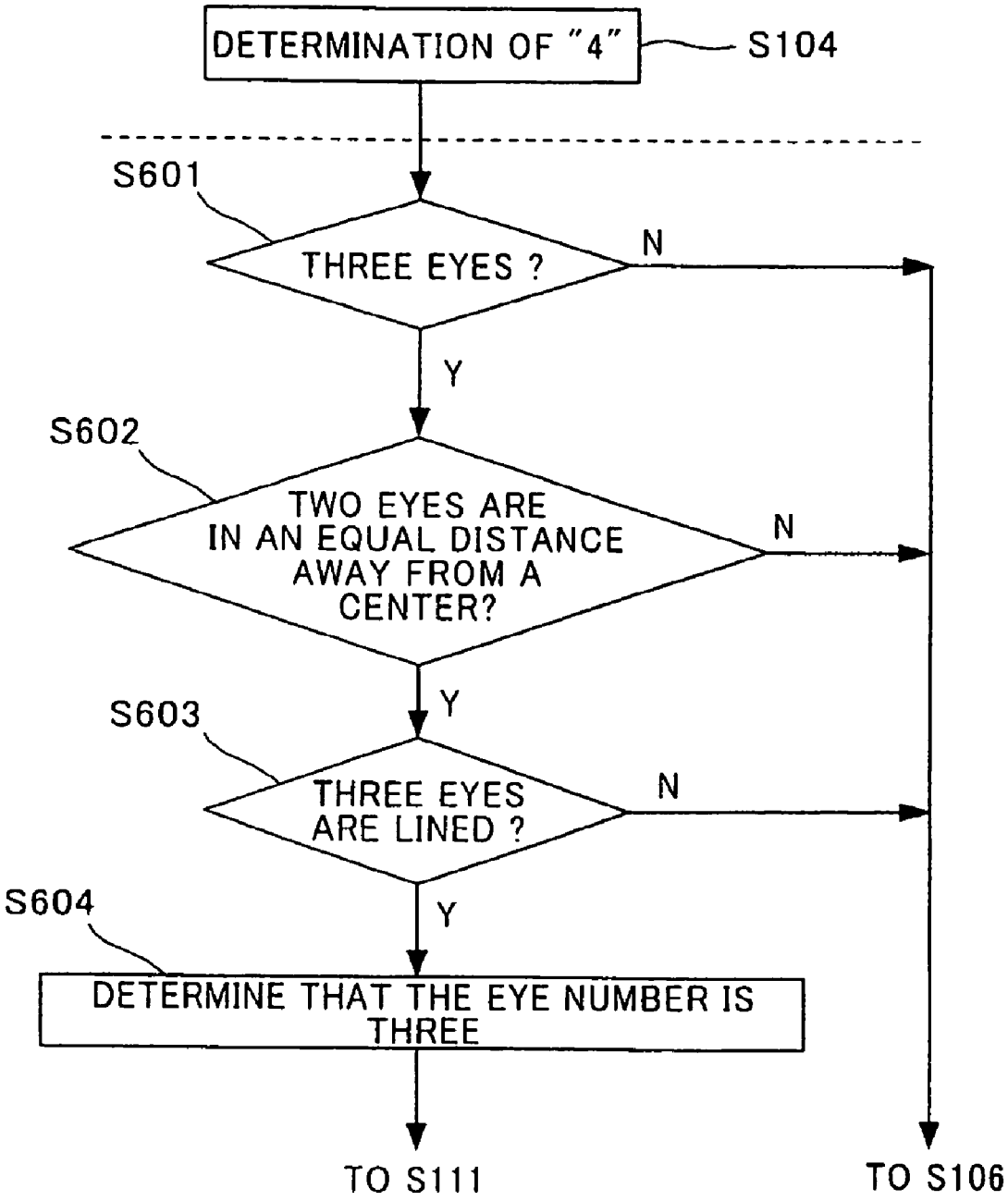
FIG. 16 is a flow chart showing a detailed processing in S105 in FIG. 4.

FIG. 16 shows a determination processing of the eye number "3".

Figure 17:
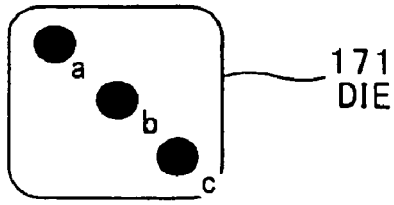
FIG. 17 is an explanation view showing an eye location in an eye pattern of the eye number "3" on the die.

FIG. 17 shows an eye location of the eye number pattern "3". In FIG. 17, whether or not three eyes "a", "b", and "c" of the die 171 show the eye number pattern "3" can be determined based upon the following conditions. The eye number "3" of the die 171, as shown in FIG. 5, is a pattern where three black eyes are arrayed. Accordingly if the two eyes exist in an equal distance away from the center and in a linear line, the eye number "3" can be determined. Namely when the following two conditions are met, the eye number "3" can be determined.

Condition 1: |"a"−"b"|≈|"b"−"c"| (equal clearance)

Condition 2: ("a"−"b"·"b"−"c")/(|"a"−"b"|·|"b"−"c"|)≈1 (series)

The determination processing of the eye number "3" will be explained with reference to FIG. 16. First, it is determined whether or not the number of black eyes is three (S601). Only this determination does not enable distinction to three eyes lined obliquely in the eye number "5". Accordingly it is determined whether or not two black eyes are located in the same distance away from the center of the three eyes (S602). Next, in a case two black eyes exist in the same distance away from the center, it is determined whether or not the three black eyes including the two black eyes are located in a linear line (S603).

In a case the above conditions are cleared, it is determined the eye number is "3" (S604), the processing goes to S111 in FIG. 1. And in a case even one of the three conditions is not cleared, it is not determined that the eye number is "3", and the processing goes to S106 in FIG. 1.

Figure 18:
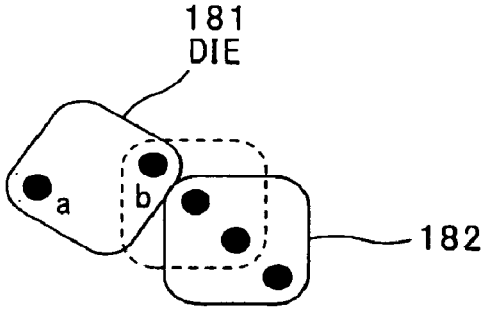
FIG. 18 is an explanation view showing a state where two dice, are put together to form the eye number "3" in a contacting part.

FIG. 18 shows a case where two dice 181, 182 are located in a collective state and three eyes are formed in the contacting portion between the two dice. In a case the eye number of the die 181 is "2" and the eye number of the die 182 is "3", the eyes of the eye number "3" are formed by two eyes of the die 182 and one eye of the die 181. The processing to prevent the eyes "3" in this state from being determined as the eye number "3" in error is the same as in a case in FIG. 13 and consideration is paid to the eye positioned in the outmost end in the image, which may be processed using the distance between the eyes.

In a case the eye to meet the two determination conditions of the eye number "3" does not exist, two eyes "a", "b" are determined as the eyes of the eye number "2". However, for determinations of the eye numbers "3" and "2", it is the condition that any one of the eyes does not have the feature of the eye number "1". It is noted that when it is already determined that the eye number is "1", this determination is not necessary.

Figure 19:
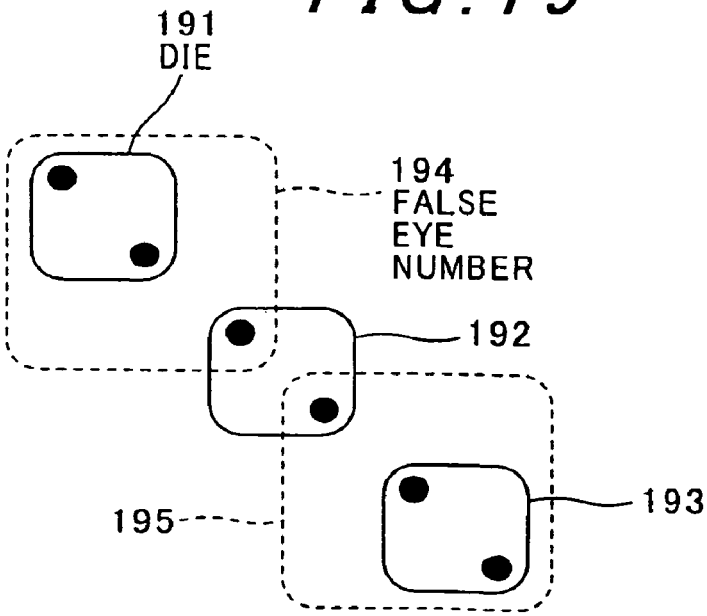
FIG. 19 is an explanation view showing an example where in case two dice are put together, the eye number "2" or "3" is formed depending on their location relation.

FIG. 19 shows a case where when three dice are collected, the eye numbers "2" and "3" are formed depending on the location relation of the three dice. For example, six eyes of three dice 191, 192, 193, each having the eye number "2", are located in a linear line, two sets of the eye number "3" shown in a dotted line frame and one set of the eye number "2" of the die 192 between the two sets tend to exist in the linear line. Namely false eye numbers 194, 195 tend to are generated. However, the false eye numbers can be distinct based upon a clearance between the eyes. An allowance range of the clearance between the eyes may be defined by limiting the size of the die or based upon a diameter or the like of the eye.

Figure 20:
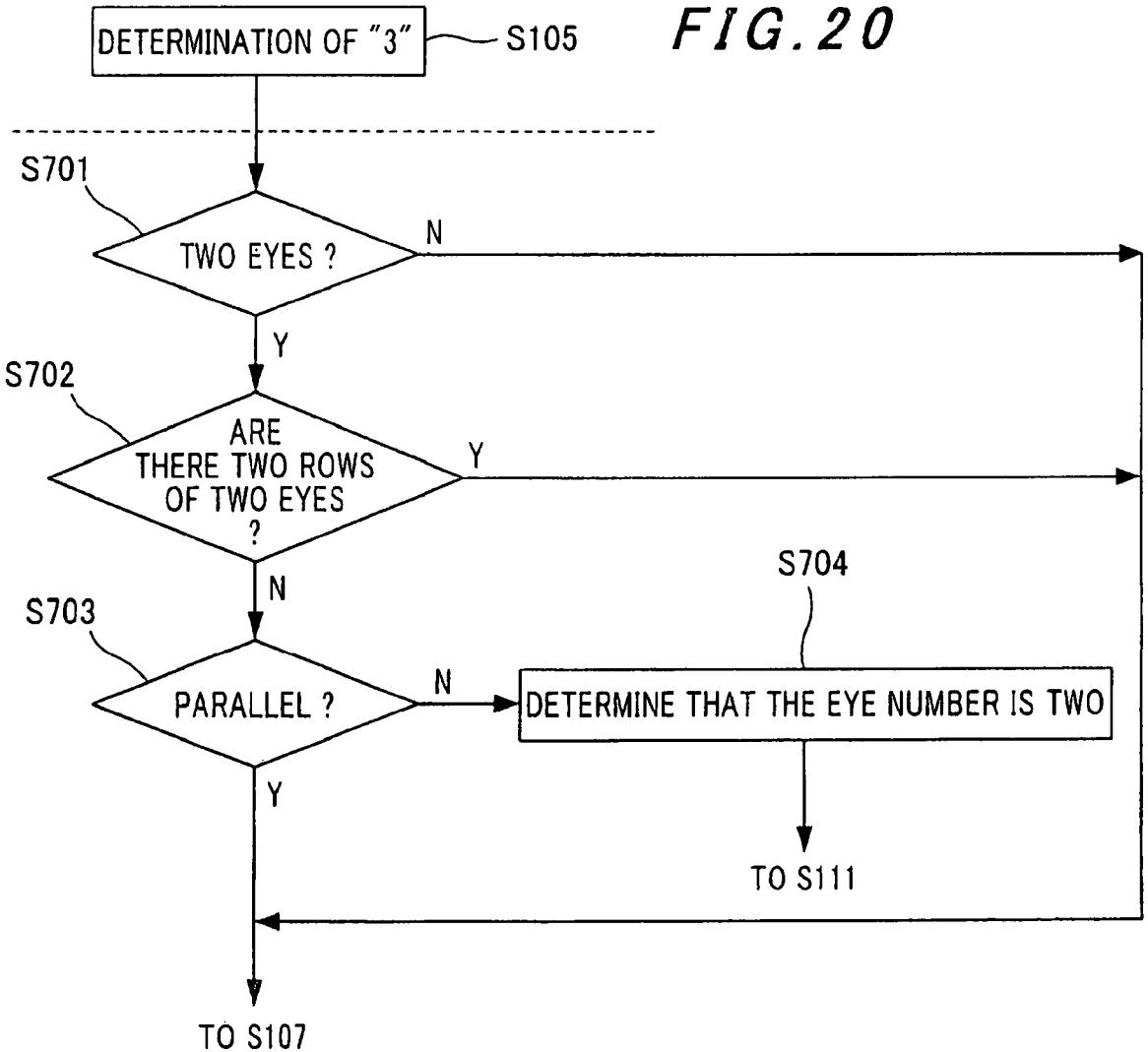
FIG. 20 is a flow chart showing a detailed processing in S106 in FIG. 4.

FIG. 20 shows a determination processing of the eye number "2". The eyes of the eye number "2" of the die, as shown in FIG. 5, has two eyes. The eye number "2" is determined as "2" based upon that two black eyes are in a line, as well as the eye number "2" is not a square shape (distinction to the eye number "4" is possible by it). However, an erroneous recognition with regard to the eye numbers "2", "3" possibly occurs depending on the location relation, and the erroneous recognition can be avoided based upon the clearance between the eyes.

First, it is determined whether or not the number of the eyes of the die is two (S701). Next, the eye number is determined as "2" (S704) based upon a state where two eyes are not formed by two rows of one eye and two rows of two eyes are not parallel unlike the eye number "4" (S702, S703), and then the processing goes to S111 in FIG. 1. When even one of the determinations of S701-S703 is not cleared, it is not determined that the eye number is "2", and the processing goes to S107 in FIG. 1.

Figure 21:
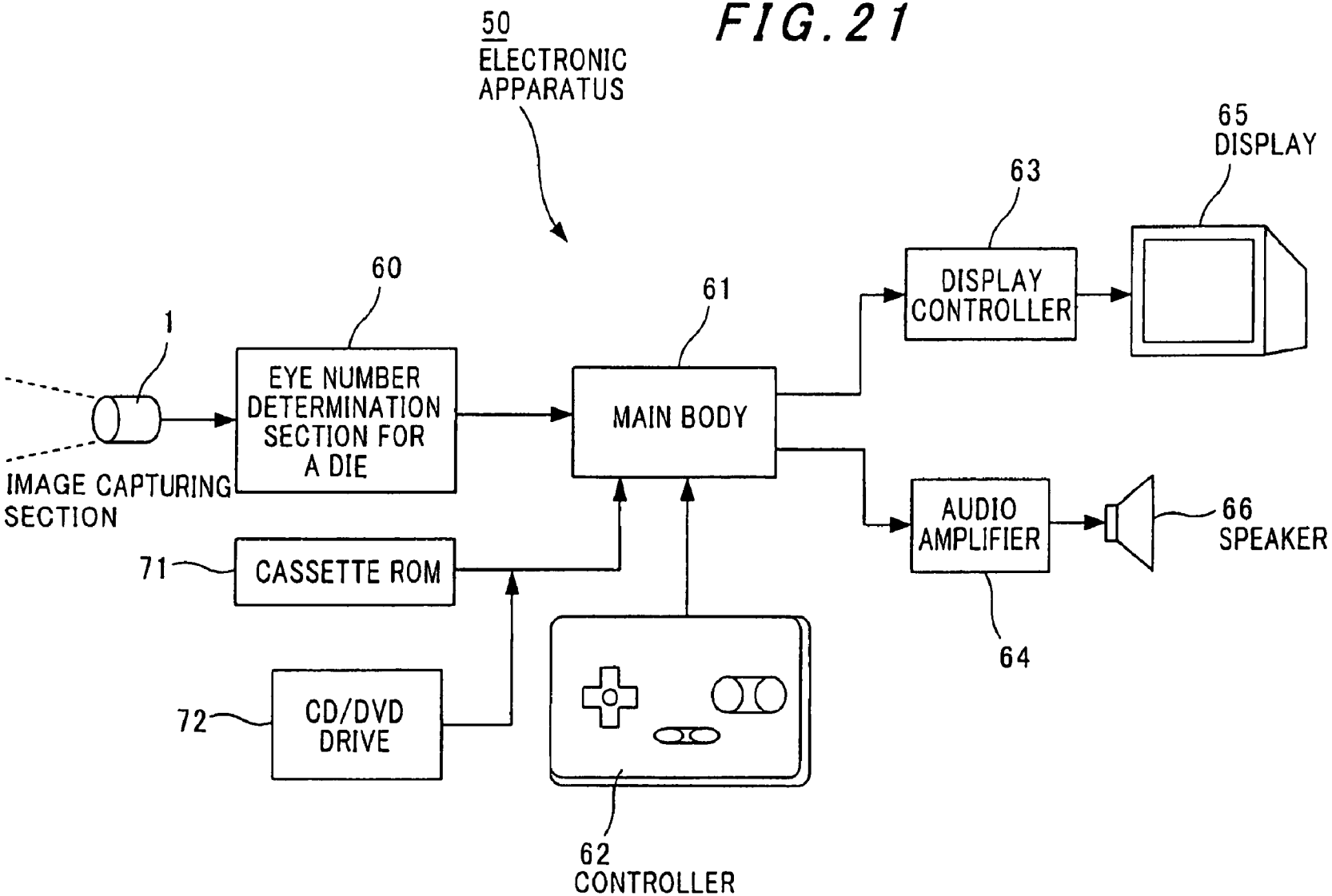
FIG. 21 is a block diagram showing an electronic apparatus in a second preferred embodiment according to the present invention.

FIG. 21 shows an electronic apparatus in a second preferred embodiment according to the present invention. This electronic apparatus is an electronic apparatus 50 for a game formed with the die eye number determination apparatus 10 and the image-capturing section shown in FIGS. 1-3.

Nowadays there are various kinds of game machines. It is popular that a memory medium such as a CD (compact disc) storing game software or a ROM cassette storing a semiconductor memory therein is installed to play a game. On the other hand, a game using a traditional die is a different fun. However, when a player recognizes eyes of a die with a player's eyes in a game using such a die, and determines the eye number of a die by a player's judgment, generations familiar with electronic game machines tend to have a sense of discomfort for such game. If determination of the eye number of a die is electronically processed, users for electronic game machines can be excited about games using the die. The electronic apparatus 50 in the second preferred embodiment according to the present invention is provided to meet such demand.

FIG. 21 shows the electronic apparatus 50 that comprises a die eye number determination section 60 having substantially the same components with the die eye number determination apparatus 10, a main body section 61 to which a cassette ROM 71 or a CD/DVD drive 72 is mounted, a controller 62 for games operated by a player, a display controller 63 for display control, a display 65 connected to the display controller 63, an audio amplifier 64 connected to the main body section 61 to amplify voices, and a speaker 66 connected to the audio amplifier 64 to output voices.

The die eye number determination section 60 is formed of the die eye number determination apparatus 10 excluding the display control section 6, the display section 7, the audio processing section 8, and the speaker 9. The excluded functions are performed by the display controller 63 connected to the main body section 61, the display 65, the audio amplifier 64, and the speaker 66 as alternatives.

The main body section 61 is a computer comprising a CPU, a ROM, a RAM, a bus interface, an input/output interface, and power source section and is operated by programs stored in the ROM. The controller 62 for the game is operated by a player in playing a game, and is equipped with a function key, a cross key, and other keys and is connected to the main body section 61 through a cable. The display 65 may be formed of a CRT, a crystal display or the like.

Herein the display 65 is a display exclusively for games, but if the display 65 is connected to the main body section 61 through a converter converting a picture signal, a receiver for TV broadcasting may be used as a display. And the main body section 61, the display 65, and the die eye number determination section 60 are formed separately. However, these components and further the display controller 63, the audio amplifier 64, the display 65, the speaker 66, and the CD/DVD drive 72 housed in the display 65 may be integrally formed. In reverse, the display 65 and the other components may be housed in the main body section 61 for integration.

In the case of using the electronic apparatus 50, the use aspect may be provided such that game software using a die is actuated to be incorporated in the game or the electronic apparatus 50 is simply used as an eye number determination for a die/display apparatus. When a player starts to play a game by mounting the cassette ROM 71 or by setting the CD/DVD for games to the CD/DVD drive 72, the progress of the game is displayed from point to point. The game advances by operating the game controller 62 for the game. And Voices in the game are outputted through the audio amplifier 64 from the speaker 66.

In a case a game requires a die, a message is displayed on the display 65 in requiring the die (or voices are outputted). Accordingly when a player throws dice into the box 11 and rolls them, the eye number is read by the die eye number determination apparatus 10. The read contents are processed by the die eye number determination section 60 as described above, and the determination information is sent to the main body section 61. The main body section 61 displays the eye number on the display 65 through display controller 63. The main body section 61 advances the game using the eye number. It is noted that the eye number of the dice can be automatically reflected in a game or can be manually inputted based upon a player's judgment.

On the other hand, in the case of using only functions of the die eye number determination section 60, the eye number determination result is processed independently of the game. Namely the main body section 61 executes only the processing to display the eye number determination result by the die eye number determination section 60.

As explained above, incorporation of the die eye number determination section 60 into the electronic apparatus serving mainly functions as the game machine allows the eye number result of the die to be reflected during game-playing, thereby to shorten a waiting time for a game.

The electronic apparatus 50 may be equipped with a function connected to an internet (not shown in FIG. 21). Provision of this function allows a player to enjoy a game through an internet without use of a cassette ROM, CD software, DVD software, and the like, and in addition, game software can be downloaded from an internet.

In the above-mentioned preferred embodiments, the eye number determination is performed in order of "1", "6", "5", "4", "3", and "2". However, in a case only one die is used, the determination of the eye number "1" is not necessarily performed first. And the reason why the determination is performed in order from the large number to the small number ("6" . . . "2") is that the processing for the small number of eyes is easier by determining the larger eye numbers at first, thereby to shorten the entire processing time. However, random order may be performed.

And in the preferred embodiments, the dice 14, 15 are formed in a square shape, but may be in a polygonal shape. In a case the die is formed in a polygonal shape, the number of the eyes, in addition of "1"-"6", may include "7" or more. In this case, corresponding sections in the processing shown in FIG. 6, FIG. 7, FIG. 9, FIG. 12, FIG. 16, and FIG. 20 may be adopted and the processing program may be timely changed in accordance with the number of the eyes.

Further, the present invention can be applied to a die with an eye in the shape of not only a point but also a diamond, a quadrangle or the like, or also to a die on which a number is described, such as "1", "2", . . . , or to a die on which a picture letter, a code or the like is displayed. In this case since a number is only recognized directly in place of image recognition of eyes, the determination processing is simpler than the above-mentioned methods. The color of the eye is generally black in addition of red, but other colors may be used.

The box 11 is formed in a square, but may be in another shape, for example, a cylindrical shape, or an oval shape. Further, a shape of the component corresponding to the box is not limited to a box shape and in particular, in FIG. 3, the image-capturing section may be formed by mounting a pole to a stand having a base of an L-letter shape or a reverse L-shape.

If the present invention is applied to a commercial product for schoolers, an appearance of the box may be imitated by a doll, an animal, a vehicle, a building or the like to establish a space at a part of the box for rolling a die.

In FIG. 1, the reset switch 13 is disposed in the box 11, but may be disposed in the main body side housing an electronic circuit therein. And if the program to actuate the reset at a certain cycle is incorporated in a ROM 4, the reset switch 13 can be omitted.

Further, if the dice 14, 15 are disposed in the box 11 and the box 11 is upheld/shaken with the dice remained inside the box 11, as well as the upholding of the box 11 is detected by a sensor, the reset switch 13 can also be omitted.

And in a case the eye of the eye number "1" is not red and is not the black eye of a large size, it is difficult to determine the eye number "1". Accordingly, if a stick seal of a red eye corresponding to the eye "1" or a stick seal where a large black eye is printed is enclosed/sold in selling a die eye number determination apparatus, the above problem is solved.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A die eye number determination method, comprising:

providing a plurality of dice, each of the dice including at least six faces, wherein the at least six faces of the die includes from one eye to at least six eyes;

capturing an image of the dice each including at least one face of the at least six faces to generate an image signal;

determining two eyes having a longest distance in the captured image as eyes positioned at outermost ends in the captured image;

setting one of the two eyes positioned at the outermost ends of the captured image as an unprocessed end eye;

determining an eye number of each of the dice based upon the unprocessed end eye in the image signal on a condition of at least one of a feature, a number, and a location relation of the one eye to at least the six eyes in a predetermined area of the captured image; and repeating the determining the eye number by setting an eye positioned close to the unprocessed end eye as a next unprocessed end eye in order, until all eyes in the captured image are processed;

wherein the determining said eye number comprises determining whether the unprocessed end eye includes a feature of an eye number "1", and thereafter determining whether the unprocessed end eye includes a feature of an eye number "6" based on a clearance between the unprocessed end eye with other eyes and subsequently, in order, to a feature of a smaller number of eyes.

2. The die eye number determination method according to claim 1, wherein the feature of the eye number "1" comprises one of:

a color of an eye is a different color than colors of other eyes; and a size of the eye is larger in size than a size of the other eyes.

3. The die eye number determination method according to claim 1, wherein the determining said eye number further comprises:

determining the eye number to be "6" when an eye closest to the unprocessed end eye is a central eye of three eyes of a pattern "6" in which the plurality of eyes include two parallel rows of three eyes, and a distance between the two parallel rows is less than a length of one row, and when a distance between central eyes of each set of three eyes is less than a length of one of first and second sets of three eyes.

4. The die eye number determination method according to claim 1, wherein the determining said eye number further comprises:

determining the eye number to be "5" when the unprocessed end eye is any one of four eyes other than a central eye of a pattern "5" in which five eyes are located to form a cross, three eyes exist in one row of the cross, and four eyes are located an equal distance away from the central eye that is closest to the unprocessed end eye, and when a size of a formed pattern "5" is not larger than a size of an actual pattern "5".

5. The die eye number determination method according to claim 1, wherein the determining said eye number further comprises:

determining the eye number to be "4" when the unprocessed end eye and other three eyes form a pattern "4" in which two sets of two eyes exist, and are located in the two rows and in parallel with respect to each other, and each of four eyes is located an equal distance to two closest adjacent eyes, and a specified eye in a formed pattern "4" is a part of an actual pattern "4".

6. The die eye number determination method according to claim 1, wherein the determining said eye number further comprises:

determining the eye number to be "3" when the unprocessed end eye and other tow eyes forms a pattern "3" in which three eyes are located in a linear line and two eyes of the three eyes are located in an equal distance from a central eye of the three eyes.

7. The die eye number determination method according to claim 1, wherein the determining said eye number further comprises:

determining the eye number to be "2" when the unprocessed end eye and other one eye forms a pattern "2" in which two eyes are located within a predetermined distance, and not in two rows and not in parallel.

8. A die eye number determination apparatus, comprising:

an image-capturing section to capture at least one eye on one face of a plurality of dice that outputs image information;

a vessel, including a space for rolling the at least the one die, wherein the image-capturing section is located in one of a lower part and an upper part thereof;

a determination section that determines two eyes having a longest distance in the captured image as eyes positioned at outermost ends in the captured image, sets one of the two eyes positioned at the outermost ends of the captured image as an unprocessed end eye, determines an eye number of each of the dice based upon the unprocessed end eye in the image information captured by the image-capturing section on a condition of at least one of a feature, a number, and a location relation of the eyes in a predetermined area of a captured image, and repeats the determining the eye number by setting an eye positioned close to the unprocessed end eye as a next unprocessed end eye in order, until all eyes in the captured image are processed; and an output section to one of display and audibly announce a determination result based on said determined eye number as one of a numerical value and an output, the determination result comprising die information for an electronic game, wherein the determining said eye number comprises determining whether the unprocessed end eye includes a feature of an eye number "1", and thereafter determining whether the unprocessed end eye includes a feature of an eye number "6" based on a clearance between the unprocessed end eye with other eyes and subsequently, in order, to a feature of a smaller number of eyes.

9. The die eye determination apparatus according to claim 8, wherein the vessel comprises a transparent board horizontally disposed at a bottom section of the space, and the image-capturing section image-captures the lower face of the die by setting substantially an entire area of the transparent board as a field of view and a focused range, the image-capturing section comprising one of; an image-capturing element securely installed;

a camera housing the image-capturing element therein; and an optical scanning system that one of optically and mechanically image-captures the lower face of the die by an image sensor integral with an illumination lamp located under the transparent board.

10. The die eye number determination apparatus according to claim 8, wherein the image-capturing section comprises:

one of an image-capturing element and a camera to image-capture the upper face of the die by setting the space where the die is rolled as a field of view and a focused range; and a stand section enabling the rolling of the die into the space, and to hold one of the image-shooting section and the camera at a predetermined height.

11. An electronic apparatus equipped with a game-playing function to play a game provided by one of a memory medium storing game software and by connection to an internet, and to output images and audio during the game-playing through an external display and an external speaker, the electronic apparatus comprising:

a die eye number determination section to capture an image of at least one eye on one face on a plurality of dice that outputs image information that determines two eyes having a longest distance in the captured image as eyes positioned at outermost ends in the captured image, sets one of the two eyes positioned at the outermost ends of the captured image as an unprocessed end eye, determines an eye number of each of the dice based upon the unprocessed end eye in the image information on a condition of at least one of a feature, a number, and a location relation of the eyes in a predetermined area of the image, and repeats the determining the eye number by setting an eye positioned close to the unprocessed end eye as a next unprocessed end eye in order, until all eyes in the captured image are processed, wherein the determining said eye number comprises determining whether the unprocessed end eye includes a feature of an eye number "1", and thereafter determining whether the unprocessed end eye includes a feature of an eye number "6" based on a clearance between the unprocessed end eye with other eyes and subsequently, in order, to a feature of a smaller number of eyes.

* * * * *